US006045219A

United States Patent [19]

Erdtmann et al.

[11] Patent Number: 6,045,219

[45] Date of Patent: Apr. 4, 2000

[54] PIGMENTED INK JET PRINTS ON GELATIN OVERCOATED WITH HARDENERS

[75] Inventors: David Erdtmann; Charles E. Romano; Thomas W. Martin, all of Rochester, N.Y.

[73] Assignee: Eastman Kodak Company, Rochester, N.Y.

[21] Appl. No.: 09/083,605

[22] Filed: May 22, 1998

[51] Int. Cl.[7] ..... B41J 2/01

[52] U.S. Cl. ..... 347/101; 427/337

[58] Field of Search ..... 347/101, 1, 33; 427/337, 343

[56] References Cited

U.S. PATENT DOCUMENTS

| | | | |
|---|---|---|---|
| 2,059,817 | 11/1936 | Sheppard et al. . | |
| 2,992,109 | 7/1961 | Allen . | |
| 2,994,611 | 8/1961 | Heyna et al. . | |
| 3,232,763 | 2/1966 | Burness . | |
| 3,304,179 | 2/1967 | Field et al. . | |
| 3,360,372 | 12/1967 | Burness et al. . | |
| 3,490,911 | 1/1970 | Burness et al. . | |
| 3,565,632 | 2/1971 | Mills et al. . | |
| 3,635,718 | 1/1972 | Froehlich et al. . | |
| 3,640,720 | 2/1972 | Cohen . | |
| 3,642,486 | 2/1972 | Burness et al. . | |
| 3,689,724 | 9/1972 | Labude . | |
| 3,762,926 | 10/1973 | Himmelmann et al. . | |
| 4,597,794 | 7/1986 | Ohta et al. . | |
| 5,085,698 | 2/1992 | Ma et al. . | |
| 5,172,133 | 12/1992 | Suga et al. . | |
| 5,294,946 | 3/1994 | Gandy et al. | 347/33 |
| 5,324,349 | 6/1994 | Sano et al. . | |
| 5,476,540 | 12/1995 | Shields et al. | 106/20 R |
| 5,656,378 | 8/1997 | Lambert | 428/478.2 |
| 5,847,738 | 12/1998 | Tutt et al. | 347/101 |

OTHER PUBLICATIONS

The Theory of the Photographic Process, 4th Ed., T.H. James, 1977 Macmillan Publishing Co. pp. 77–87.

*Primary Examiner*—Matthew S. Smith
*Attorney, Agent, or Firm*—Harold E. Cole

[57] ABSTRACT

A method of improving the durability of an ink jet ink image comprising the steps of: a) providing an ink jet ink receiving layer containing gelatin; b) depositing pigment-based ink jet ink to form an image on the gelatin-containing ink receiving layer; and c) applying to the image formed in step b) a solution comprising a hardener.

25 Claims, No Drawings

PIGMENTED INK JET PRINTS ON GELATIN OVERCOATED WITH HARDENERS

CROSS REFERENCE TO RELATED APPLICATIONS

The present invention is related to commonly assigned, concurrently filed:

(1) U.S. patent application Ser. No. 09/083,673, filed May 22, 1998, entitled "PRINTING APPARATUS WITH SPRAY BAR FOR IMPROVED DURABILITY" of Wen et al., (2) U.S. patent application Ser. No. 09/083,870, filed May 22, 1998, entitled "PRINTING APPARATUS WITH PROCESSING TANK" of Wen et al., (3) U.S. patent application Ser. No. 09/083,876, filed May 22, 1998, entitled "INK JET PRINTING APPARATUS WITH PRINT HEAD FOR IMPROVED IMAGE QUALITY" of Wen et al., (4) U.S. patent application Ser. No. 09/083,875, filed May 22, 1998, entitled "INK JET IMAGES ON PVA OVERCOATED WITH HARDENER SOLUTION" of Erdtmann et al., (5) U.S. patent application Ser. No. 09/083,871, filed May 22, 1998, entitled "WATERFAST INK JET IMAGES TREATED WITH HARDENERS".

The disclosures of these related applications are incorporated herein by reference.

FIELD OF THE INVENTION

This invention relates to aqueous inks which utilize pigments as colorants and which are useful for ink jet printing applications. Specifically, this invention relates to solutions containing hardeners which, when applied simultaneously with pigmented inks, or when applied over pigmented ink images which have been previously printed onto gelatin recording elements, improve waterfastness and wet adhesion properties throughout the image.

BACKGROUND OF THE INVENTION

The methods and formulations employed in inkjet imaging processes involve the application of liquid ink droplets in a pixel-by-pixel manner to an ink-receiving element. There are numerous schemes which may be utilized to control the deposition of ink droplets on the image-recording element to yield the desired image. In one process, known as continuous ink jet, a continuous stream of droplets is charged and deflected in an imagewise manner onto the surface of the image-recording element, while unimaged droplets are caught and returned to the ink sump. In another process, known as drop-on-demand ink jet, individual ink droplets are projected as needed onto the image-recording element to form the desired image. Common methods of controlling the projection of ink droplets in drop-on-demand printing include piezoelectric transducers and thermal bubble formation.

The inks used in the various ink jet printers can be classified as either dye-based or pigment-based. A dye is a colorant which is molecularly dispersed or solvated by the carrier medium. The carrier medium can be a liquid or a solid at room temperature. A commonly used carrier medium is water or a mixture of water and organic cosolvents. Each individual dye molecule is surrounded by molecules of the carrier medium. In dye-based inks, no particles are observable under the microscope. Although there have been many recent advances in the art of dye-based ink jet inks, such inks still suffer from deficiencies such as low optical densities on plain paper and poor lightfastness. When water is used as the carrier medium, such inks also generally suffer from poor waterfastness.

Pigment-based inks have been gaining in popularity as a means of addressing these limitations. In pigment-based inks, the colorant exists as discrete particles. These pigment particles are usually treated with addenda known as dispersants or stabilizers which serve to keep the pigment particles from agglomerating and/or settling out. Pigment-based inks suffer from a different set of deficiencies than dye-based inks. One deficiency is related to the observation that pigment-based inks interact differently with specially coated papers and films, such as the transparent films used for overhead projection and the glossy papers and opaque white films used for high quality graphics and pictorial output In particular, it has been observed that pigment-based inks produce imaged areas that are entirely on the surface of coated papers and films. This results in images which have poor dry and wet adhesion properties, resulting in images which can be easily smudged.

U.S. Pat. No. 5,324,349 discloses pigmented inks for ink jet printing comprising monosaccharides, disaccharides, oligosaccharides including trisaccharides and tetrasacchrides, and polysaccharides (e.g., alginic acid, alpha cyclodextrin and cellulose). These additives have a very low molecular weight, below about 1000 and are all water soluble. They are used to prevent plugging of ink jet nozzles. Such additives will not improve image quality or fastness of ink jet printed images.

Commonly owned U.S. patent application Ser. No. 08/847,858, filed Apr. 28, 1997, entitled "Pigmented Ink Jet Inks Containing Aldehydes" of Martin et al., and U.S. patent application Ser. No. 08/896,520 filed Apr. 28, 1997, entitled "Pigmented Ink Jet Inks Containing Olefins" of Martin et al., disclose ink jet ink formulations containing compounds with aldehyde, blocked aldehyde and active olefinic functional groups. However, these references do not teach the use of a solution that is separate and distinct from the ink.

SUMMARY OF TE INVENTION

The present invention discloses that when a solution containing hardener is applied over a pigmented ink image where the image receiving layer is comprised of gelatin, the waterfastness and wet adhesion properties of the image are improved.

The present invention discloses a method of improving the durability of an ink jet ink image comprising the steps of:

a) providing an ink jet ink receiving layer containing gelatin;

b) depositing pigment-based ink jet ink to form an image on the gelatin-containing ink receiving layer; and c) applying to the image formed in step b) a solution comprising a hardener.

Also disclosed is a method wherein the organic compound is 2,3-dihydroxy-1,4-dioxane (DHD) and the inorganic compound is aluminum sulfate.

This process offers an advantage over incorporating the additives into inks since the additive can be applied in both imaged and non-imaged areas, and the laydown can be precisely controlled independently of ink laydown. In the context of this invention, hardeners are defined as any additive which causes chemical cross-linking.

Preferred hardeners include formaldehyde and compounds that contain two or more aldehyde functional groups such as glyoxal, gluteraldehyde and the like.

Other preferred hardeners include compounds that contain blocked aldehyde functional groups such as aldehydes of the type tetrahydro4-hydroxy-5-methyl-2(1H)-pyrimidinone polymers (Sequa SUNREZ® 700), polymers of the type having a glyoxal polyol reaction product consisting of 1 anhydroglucose unit: 2 glyoxal units (SEQUAREZ® 755 obtained from Sequa Chemicals, Inc.), DME-Melamine non-formaldehyde resins such as Sequa CPD3046-76 obtained from Sequa Chemicals Inc., 2,3-dihydroxy-1,4-dioxane (DHD), and the like. Blocked hardeners are substances, usually derived from the active hardener, that release the active compound under appropriate conditions (The Theory of the Photographic Process, $4^{th}$ Edition, T. H. James, 1977, Macmillan Publishing CO., page 81). All are employed at concentrations ranging from 0.10 to 5.0 weight percent of active ingredients in the solution.

Other preferred hardeners are compounds that contain active olefinic functional groups such as bis-(vinylsulfonyl)-methane (BVSM), bis-(vinylsulfonyl-methyl) ether (BVSME), 1,3,5-triacryloylhexahydro-s-triazine, and the like. In the context of the present invention, active olefinic compounds are defined as compounds having two or more olefinic bonds, especially unsubstituted vinyl groups, activated by adjacent electron withdrawing groups (The Theory of the Photographic Process, $4^{th}$ Edition, T. H. James, 1977, Macmillan Publishing Co., page 82). All are employed at concentrations ranging from 0.10 to 5.0 weight percent of active ingredients in the solution.

Still other preferred additives are inorganic hardeners such as aluminum salts, especially the sulfate, potassium and ammonium alums, ammonium zirconium carbonate, chromium salts such as chromium sulfate and chromium alum, and salts of titanium dioxide, zirconium dioxide, and the like. All are employed at concentrations ranging from 0.10 to 5.0 weight percent of active ingredients in the solution.

Furthermore, the results indicate that improved waterfastness, wet adhesion, and image quality properties on gelatin coated papers and films can be achieved when solutions containing the combination of an inorganic and an organic hardener are overcoated onto the pigmented ink image. This result was unexpected. Most preferred is the combination of chrome alum (chromium(III) potassium sulfate dodecahydrate) or aluminum sulfate and 2,3-dihydroxy-1,4-dioxane (DHD) at total hardener concentrations ranging from 0.10 to 5.0 wt %. Most preferred is the combination of aluminum sulfate and 2,3-dihydroxy-1,4-dioxane (DHD) having a total hardener concentration ranging between 0.25 and 2.0 weight percent of active ingredients in the solution.

The hardener solution of the invention comprises an aqueous solution including one or more hardeners. In addition, surfactants, biocides, chelating agents, penetrants, thickeners, conductivity enhancing agents, anti-kogation agents, drying agents, defoamers, and humectants may be added.

The ink-receiving layer consists of gelatin, and may also contain varying levels of matting agents for the purpose of controlling gloss, friction, and/or fingerprint resistance; surfactant(s) to improve coatability and to adjust the surface tension of the dried coating; anti-oxidants; UV absorbing compounds; light stabilizers; and the like.

The hardener solutions of the present invention are overcoated onto an imaging layer consisting primarily of gelatin. When applied during or after printing with pigmented inks, the printed images exhibit excellent waterfastness and have excellent wet adhesion properties throughout.

DETAILED DESCRIPTION OF THE INVENTION

Inks useful for ink jet recording processes generally comprise at least a mixture of a solvent and a colorant. The preferred solvent is de-ionized water, and the colorant is either a pigment or a dye. Pigments are often preferred over dyes because they generally offer improved waterfastness and lightfastness on plain paper.

Pigmented inks are most commonly prepared in two steps:

1. a pigment milling step in which the as-received pigment is deaggregated into its primary particle size, and
2. a dilution step in which the pigment mill grind is converted into a useable ink.

Processes for preparing pigmented ink jet inks involve blending the pigment, an additive known as a stabilizer or dispersant, a liquid carrier medium, grinding media, and other optional addenda such as surfactants and defoamers. This pigment slurry is then milled using any of a variety of hardware such as ball mills, media mills, high speed dispersers, and roll mills.

In the practice of the present invention, any of the known pigments can be used. The exact choice of pigment will depend upon the specific color reproduction and image stability requirements of the printer and application. For a list of pigments useful in ink jet inks, see U.S. Pat. No. 5,085,698, column 7, line 10 through column 8, line 48.

The liquid carrier medium can also vary widely and again will depend on the nature of the inkjet printer for which the inks are intended. For printers which use aqueous inks, water, or a mixture of water with miscible organic co-solvents, is the preferred carrier medium.

The dispersant is another important ingredient in the mill grind. Although there are many dispersants known in the art, the best dispersant will be a function of the carrier medium and also often varies from pigment to pigment. Preferred dispersants for aqueous inkjet inks include sodium dodecyl sulfate, acrylic and styrene-acrylic copolymers, such as those disclosed in U.S. Pat. Nos. 5,085,698 and 5,172,133, and sulfonated styrenics, such as those disclosed in U.S. Pat. No. 4,597,794. Our most preferred dispersants are salts of oleyl methyl tauride.

In the dilution step, other ingredients are also commonly added to pigmented ink jet inks. Cosolvents (0–20 wt % ) are added to help prevent the ink from drying out or crusting in the orifices of the printhead or to help the ink penetrate the receiving substrate, especially when the substrate is a highly sized paper. Preferred cosolvents for the inks of the present invention are glycerol, ethylene glycol, propylene glycol, 2-methyl-2,4-pentanediol, diethylene glycol, and mixtures thereof, at overall concentrations ranging from 5 to 15 wt %.

A biocide (0.0001–1.00 wt % ) may be added to prevent unwanted microbial growth which may occur in the ink over time. A preferred biocide for the inks of the present invention is Proxel GXL™ (1,2,-benzisothiazolin-3-one, obtained from Zeneca Colours) at a final concentration of 0.005–0.5 wt %.

Additional additives which may optionally be present in ink jet inks include thickeners, conductivity enhancing agents, anti-kogation agents, drying agents, and defoamers.

In one embodiment of the present invention, an aqueous solution comprising one or more co-solvents, a surfactant, and a hardener is applied to the pigmented inkjet image in a non-imagewise fashion, either through a separate thermal or piezoelectric printhead, or in any other method which can apply the hardener solution evenly to the image (e.g., a spray bar). Alternatively, the receiver with the image can be processed in a tank containing the hardener solution. Methods of applying the hardener solution are disclosed in commonly owned U.S. patent application Ser. No. 09/083,673, filed May 22, 1998, entitled "Printing Application With Spray Bar For Improved Durability" of Wen et al., U.S. patent application Ser. No. 09/083,870, filed May 22, 1998, entitled "Printing Apparatus With Processing Tank" of Wen et al., U.S. patent application Ser. No. 09/083,876, filed May 22, 1998, entitled "Ink Jet Printing Application With Print Head For Improved Quality" of Wen et al., filed on even date herewith. The contents of these applications are incorporated herein in their entirety.

Besides those already listed above, it is contemplated that other aldehyde containing compounds that are effective hardeners are also usefull in the practice of this invention. Some compounds known to be effective hardeners are 3-hydroxybutyraldehyde (U.S. Pat. No. 2,059,817), crotonaldehyde, the homologous series of dialdehydes ranging from glyoxal to adipaldehyde, diglycolaldehyde (U.S. Pat. No. 3,304,179) various aromatic dialdehydes (U.S. Pat. No. 3,565,632 and U.S. Pat. No. 3,762,926), and polymeric dialdehydes such as dialdehyde starch and dialdehyde derivatives of plant gums. Most preferred are formaldehyde, glutaraldehyde, succinaldehyde, and glyoxal.

Likewise, it is also contemplated that other hardeners may be useful in the context of this invention. Some compounds known to be effective hardeners are blocked aldehydes such as 2,3-dihydroxy-1,4-dioxane (DHD), tetrahydro-4-hydroxy-5-methyl-2(1H)-pyrimidinone polymers, polymers of the type having a glyoxal polyol reaction product consisting of 1 anhydroglucose unit: 2 glyoxal units; DME-Melamine non-formaldehyde resins; N-methylol compounds obtained from the condensation of formaldehyde with various aliphatic or cyclic amides, ureas, and nitrogen heterocycles. Most preferred is 2,3-dihydroxy-1,4-dioxane (DHD) at concentrations ranging from 0.10 to 5.0 weight percent of active ingredient in the solution.

It is contemplated that compounds with active olefinic functionality, that are effective hardeners are also usefull in the practice of this invention. Some compounds known to be effective hardeners are divinyl ketone, resorcinol bis (vinylsulfonate) (U.S. Pat. No. 3,689,274), 4,6-bis (vinylsulfonyl)-m-xylene (U.S. Pat. No. 2,994,611), bis (vinylsulfonylalkyl) ethers and amines (U.S. Pat. No. 3,642,486 and U.S. Pat. No. 3,490,911), 1,3,5-tris(vinylsulfonyl) hexahydro-s-triazine, diacrylamide (U.S. Pat No. 3,635,718), 1,3-bis(acryloyl)urea (U.S. Pat. No. 3,640,720), N,N'-bismaleimides (U.S. Pat. No. 2,992,109) bisisomaleimides (U.S. Pat. No. 3,232,763), bis(2-acetoxyethyl) ketone (U.S. Pat No. 3,360,372), and 1,3,5-triacryloylhexahydro-s-triazine. Blocked active olefins of the type bis(2-acetoxyethyl) ketone and 3,8-dioxodecane-1,10-bis (pyridinium perchlorate) may also be used. Most preferred is BVSM and BVSME at concentrations ranging from 0.10 to 5.0 weight percent of active ingredient in the solution.

It is further contemplated that other inorganic hardeners that are effective hardeners are also useful in the practice of this invention. Some compounds known to be effective hardeners include zirconium and titanium salts; chromium salts such as chromium sulfate and chromium alum; and aluminum salts including sulfate, potassium and ammonium alums. Most preferred is aluminum sulfate at concentrations ranging from 0.10 to 5.0 weight percent of active ingredient in the solution.

Other compounds which may act as hardeners include: acetylenes, azides, aziridines, carboxylic acid derivatives such as anhydrides, activated esters, and imido esters, epoxides such as glycidyl ethers and glyciylammonium salts, active halogen compounds, isocyanate adducts, diketones, organometallics, such as Volan™ (a complex of methacrylic acid and chromium III chloride) peptide bond forming agents such as carbodiimides, isoxazoliumsalts, N-Carbamoylpyridinium salts, and 4-Amino-1-methylsulfonylpyridinium salts, sulfonate esters, s-Triazines, mucochloric acid, and polymeric hardeners.

In addition there may be a synergistic effect from certain combinations of the above mentioned hardeners.

Additional related hardeners can be found in, The Theory Of The Photographic Process, $4^{th}$ Edition, T. H. James, 1977, Macmillan Publishing CO. pages 77–87, and in *Research Disclosure*, Vol. 365, September 1994, Item 36544, II, B. Hardeners.

EXAMPLES

Examples for Blocked Aldehydes (BALD)

Comparative Example 1

| Mill Grind | |
|---|---|
| Polymeric beads, mean diameter of 50 μm (milling media) | 325.0 g |
| Bis(phthalocyanylalumino)tetra-Phenyldisiloxane (cyan pigment) Manufactured by Eastman Kodak Company | 35.0 g |
| Oleoyl methyl taurine, (OMT) sodium salt | 17.5 g |
| Deionized water | 197.5 g |
| Proxel GXL ™ (biocide from Zeneca) | 0.2 g |

The above components were milled using a high energy media mill manufactured by Morehouse-Cowles Hochmeyer. The mill was run for 8 hours at room temperature. An aliquot of the above dispersion to yield 1.0 g. pigment was mixed with 8.00 g diethylene glycol, and additional deionized water for a total of 50.0 g. This ink was filtered through 3-μm filter and introduced into an empty Hewlett-Packard 51626A print cartridge. Images were made with a Hewlett-Packard DeskJet™ 540 printer on medium weight resin coated paper containing an imaging layer.

The resin coated paper stock had been previously treated with a corona discharge treatment (CDT) and coated with an imaging layer consisting of about 800 mg/ft$^2$ of gelatin. Good waterfastness was observed in the $D_{max}$ patch; however when the image was physically rubbed the wet adhesion was fair-poor. At a lower density patch (0.50 density) and with narrow lines (~1/32$^{nd}$ of an inch) all of the image floated to the surface when immersed in distilled water. The tests conducted for wet adhesion and waterfastness are described below.

Blocked Aldehyde (BALD) Comparative Example 2

An ink was prepared in a similar manner as described in BALD Comparative Example 1 except, the cyan pigment was replaced with 1.45 g. of a quinacridone magenta pigment (pigment red 122) from Sun Chemical Co. The ink was printed as in BALD Comparative Example 1 and poor waterfastness and wet adhesion were observed.

Blocked Aldehyde (BALD) Comparative Example 3

An ink was prepared in a similar manner as described in BALD Comparative Example 1 except, the cyan pigment was replaced with 1.25 g. of a Hansa Brilliant Yellow (pigment yellow 74) from Hoechst Chemical Co. The ink was printed as in BALD Comparative Example 1 and fair waterfastness and very poor wet adhesion were observed in the $D_{max}$ areas. In the low density areas and thin lines the pigmented image floated to the surface while immersed in water.

Blocked Aldehyde (BALD) Comparative Example 4

An ink was prepared in the same manner as that described in BALD Comparative Example 1 except, 5.00 g. of 10 wt % solution of 2,3-dihydroxy-1,4-dioxane (DHD) obtained from Aldrich was added to the mixture to obtain a final hardener concentration of 1.00 wt % of hardener in the ink. This ink was printed on resin coated paper stock which had been previously treated with a corona discharge treatment (CDT) and coated with an imaging layer consisting of about 800 mg/ft$^2$ of gelatin. Excellent waterfastness and fair-good wet adhesion were observed in the 100% fill areas ($D_{max}$); while at lower density patches, and with thin narrow lines (~1/32$^{nd}$ of an inch), the image either floated to the surface without physically rubbing, or the image rubbed off very easily.

Blocked Aldehyde (BALD) Example 1

An ink was prepared in the same manner as that described in BALD Comparative Example 1. This ink was printed on resin coated paper stock which had been previously treated with a corona discharge treatment (CDT) and coated with an imaging layer consisting of about 800 mg/ft$^2$ of gelatin.

A solution consisting of 8.0 g of diethylene glycol, 5.00 g of a 10.0% solution of Air Products Surfynol® 465, and 1.25 g of 10 wt % solution of 2,3-dihydroxy-1,4-dioxane (DHD)obtained from Aldrich was added to the mixture to obtain a final DHD concentration of 0.25 wt % of hardener in the solution, and additional deionized water for a total of 50.0 g was prepared. The overcoat solution was introduced into an empty Hewlett-Packard 51626A print cartridge. This solution was overcoated at 100% coverage on the above pigmented ink image. Excellent waterfastness and wet adhesion were observed in the 100% fill areas ($D_{max}$). Excellent waterfastness and wet adhesion properties were also observed at lower density patches, and with thin narrow lines (~1/32$^{nd}$ of an inch).

Blocked Aldehyde (BALD) Example 2

An ink was prepared and printed in the same manner as that described in BALD Example 1.

A solution consisting of 8.0 g of diethylene glycol, 5.00 g of a 10.0% solution of Air Products Surfynol® 465, and 2.50 g of 10 wt % solution of 2,3-dihydroxy-1,4-dioxane (DHD) obtained from Aldrich was added to the mixture to obtain a final DHD concentration of 0.50 wt % of hardener in the solution, and additional deionized water for a total of 50.0 g was prepared. This solution was overcoated on the above pigmented ink image. Very good waterfastness and good wet adhesion were observed in the 100% fill areas ($D_{max}$). Excellent waterfastness and wet adhesion properties were also observed at lower density patches, and with thin narrow lines (~1/32$^{nd}$ of an inch).

Blocked Aldehyde (BALD) Example 3

An ink was prepared and printed in the same manner as that described in BALD Example 1.

A solution consisting of 8.0 g of diethylene glycol, 5.00 g of a 10.0% solution of Air Products Surfynol® 465, and 5.00 g of 10 wt % solution of 2,3-dihydroxy-1,4-dioxane (DHD) obtained from Aldrich was added to the mixture to obtain a final DHD concentration of 1.00 wt % of hardener in the solution, and additional deionized water for a total of 50.0 g was prepared. This solution was overcoated on the above pigmented ink image. Very good waterfastness and good wet adhesion were observed in the 100% fill areas ($D_{max}$). Excellent waterfastness and wet adhesion properties were also observed at lower density patches, and with thin narrow lines (~1/32$^{nd}$ of an inch).

Blocked Aldehyde (BALD) Example 4

An ink was prepared in the same manner as that described in BALD Comparative Example 2. This ink was printed on resin coated paper stock which had been previously treated with a corona discharge treatment (CDT) and coated with an imaging layer consisting of about 800 mg/ft$^2$ of gelatin.

A solution consisting of 8.0 g of diethylene glycol, 5.00 g of a 10.0% solution of Air Products Surfynol® 465, and 1.25 g of 10 wt % solution of 2,3-dihydroxy-1,4-dioxane (DHD) obtained from Aldrich was added to the mixture to obtain a final DHD concentration of 0.25 wt % of hardener in the solution, and additional deionized water for a total of 50.0 g was prepared. This solution was overcoated on the above pigmented ink image. Excellent waterfastness and wet adhesion were observed in the 100% fill areas ($D_{max}$). Excellent waterfastness and wet adhesion properties were also observed at lower density patches, and with thin narrow lines (~1/32$^{nd}$ of an inch).

Blocked Aldehyde (BALD) Example 5

An ink was prepared and printed in the same manner as that described in BALD Example 4.

A solution consisting of 8.0 g of diethylene glycol, 5.00 g of a 10.0% solution of Air Products Surfynol® 465, and 2.50 g of 10 wt % solution of 2,3-dihydroxy-1,4-dioxane (DHD) obtained from Aldrich was added to the mixture to obtain a final DHD concentration of 0.50 wt % of hardener in the solution, and additional deionized water for a total of 50.0 g was prepared This solution was overcoated on the above pigmented ink image. Very good waterfastness and wet adhesion were observed in the 100% fill areas ($D_{max}$). Excellent waterfastness and wet adhesion properties were also observed at lower density patches, and with thin narrow lines (~1/32$^{nd}$ of an inch).

Blocked Aldehyde (BALD) Example 6

An ink was prepared and printed in the same manner as that described in BALD Example 4.

A solution consisting of 8.0 g of diethylene glycol, 5.00 g of a 10.0% solution of Air Products Surfynol® 465, and 5.00 g of 10 wt % solution of 2,3-dihydroxy-1,4-dioxane (DHD) obtained from Aldrich was added to the mixture to obtain a final DHD concentration of 1.00 wt % of hardener in the solution, and additional deionized water for a total of 50.0 g was prepared. This solution was overcoated on the above pigmented ink image. Very good waterfastness and excellent wet adhesion were observed in the 100% fill areas ($D_{max}$). Excellent waterfastness and wet adhesion properties were also observed at lower density patches, and with thin narrow lines (~1/32$^{nd}$ of an inch).

Blocked Aldehyde (BALD) Example 7

An ink was prepared and printed in the same manner as that described in Comparative BALD Example 3.

A solution consisting of 8.0 g of diethylene glycol, 5.00 g of a 10.0% solution of Air Products Surfynol® 465, and 1.25 g of 10 wt % solution of 2,3-dihydroxy-1,4-dioxane (DHD) obtained from Aldrich was added to the mixture to obtain a final DHD concentration of 0.25, wt % of hardener in the solution, and additional deionized water for a total of 50.0 g was prepared This solution was overcoated on the above pigmented ink image. Good waterfastness and very good wet adhesion were observed in the 100% fill areas ($D_{max}$). Excellent waterfastness and wet adhesion properties were also observed at lower density patches, and with thin narrow lines (~1/32$^{nd}$ of an inch).

Blocked Aldehyde (BALD) Example 8

An ink was prepared and printed in the same manner as that described in BALD Comparative Example 1.

A solution consisting of 8.0 g of diethylene glycol, 5.00 g of a 10.0% solution of Air Products Surfynol® 465, and 0.56 g of 45 wt % solution of a cyclic urea glyoxal condensate consisting of 1 cyclic urea unit: 1 glyoxal unit (SUNREZ® 700 obtained from Sequa Chemicals, Inc.) was added to the mixture to obtain a final hardener concentration of 0.50 wt % of hardener in the solution, and additional deionized water for a total of 50.0 g was prepared. This solution was overcoated on the above pigmented ink image. Good waterfastness and wet adhesion were observed in the 100% fill areas ($D_{max}$). Excellent waterfastness and wet adhesion properties were also observed at lower density patches, and with thin narrow lines (~1/32$^{nd}$ of an inch).

Blocked Aldehyde (BALD) Example 9

An ink was prepared and printed in the same manner as that described in BALD Comparative Example 1.

A solution consisting of 8.0 g of diethylene glycol, 5.00 g of a 10.0% solution of Air Products Surfynol® 465, and 1.67 g of 45 wt % solution of a cyclic urea glyoxal condensate consisting of 1 cyclic urea unit: 1 glyoxal unit (SUNREZ® 700 obtained from Sequa Chemicals, Inc.) was added to the mixture to obtain a final hardener concentration of 1.50 wt % of hardener in the solution, and additional deionized water for a total of 50.0 g was prepared. This solution was overcoated on the above pigmented ink image. Very good waterfastness and wet adhesion were observed in the 100% fill areas ($D_{max}$). Excellent waterfastness and wet adhesion properties were also observed at lower density patches, and with thin narrow lines (~1/32$^{nd}$ of an inch).

Blocked Aldehyde (BALD) Example 10

An ink was prepared and printed in the same manner as that described in BALD Comparative Example 2.

A solution consisting of 8.0 g of diethylene glycol, 5.00 g of a 10.0% solution of Air Products Surfynol® 465, and 0.56 g of 45 wt % solution of a cyclic urea glyoxal condensate consisting of 1 cyclic urea unit: 1 glyoxal unit (SUNREZ® 700 obtained from Sequa Chemicals, Inc.) was added to the mixture to obtain a final hardener concentration of 0.50 wt % of hardener in the solution, and additional deionized water for a total of 50.0 g was prepared. This solution was overcoated on the above pigmented ink image. Excellent waterfastness and very good wet adhesion were observed in the 100% fill areas ($D_{max}$). Excellent waterfastness and wet adhesion properties were also observed at lower density patches, and with thin narrow lines (~1/32$^{nd}$ of an inch).

Blocked Aldehyde (BALD) Example 11

An ink was prepared and printed in the same manner as that described in BALD Comparative Example 2.

A solution consisting of 8.0 g of diethylene glycol, 5.00 g of a 10.0% solution of Air Products Surfynol® 465, and 1.67 g of 45 wt % solution of a cyclic urea glyoxal condensate consisting of 1 cyclic urea unit: 1 glyoxal unit (SUNREZ® 700 obtained from Sequa Chemicals, Inc.) was added to the mixture to obtain a final hardener concentration of 1.50 wt % of hardener in the solution, and additional deionized water for a total of 50.0 g was prepared. This solution was overcoated on the above pigmented ink image. Very good waterfastness and wet adhesion were observed in the 100% fill areas ($D_{max}$). Excellent waterfastness and wet adhesion properties were also observed at lower density patches, and with thin narrow lines (~1/32$^{nd}$ of an inch).

Blocked Aldehyde (BALD) Example 12

An ink was prepared and printed in the same manner as that described in BALD Comparative Example 1.

A solution consisting of 8.0 g of diethylene glycol, 5.00 g of a 10.0% solution of Air Products Surfynol® 465, and 0.91 g of 55 wt % solution of a glyoxal polyol reacation product consisting of 1 anhydroglucose unit: 2 glyoxal units (SEQUAREZ® 755 obtained from Sequa Chemicals, Inc.) was added to the mixture to obtain a final hardener concentration of 1.00 wt % of hardener in the solution, and additional deionized water for a total of 50.0 g was prepared. This solution was overcoated on the above pigmented ink image. Very good waterfastness and excellent wet adhesion were observed in the 100% fill areas ($D_{max}$). Excellent waterfastness and wet adhesion properties were also observed at lower density patches, and with thin narrow lines (~1/32nd of an inch).

Blocked Aldehyde (BALD) Example 13

An ink was prepared and printed in the same manner as that described in BALD Comparative Example 2.

A solution consisting of 8.0 g of diethylene glycol, 5.00 g of a 10.0% solution of Air Products Surfynol® 465, and 0.91 g of 55 wt % solution of a glyoxal polyol reacation product consisting of 1 anhydroglucose unit: 2 glyoxal units (SEQUAREZ® 755 obtained from Sequa Chemicals, Inc.) was added to the mixture to obtain a final hardener concentration of 1.00 wt % of hardener in the solution, and additional deionized water for a total of 50.0 g was prepared. This solution was overcoated on the above pigmented ink image. Good waterfastness and excellent wet adhesion were observed in the 100% fill areas ($D_{max}$). Excellent waterfastness and wet adhesion properties were also observed at lower density patches, and with thin narrow lines (~1/32nd of an inch).

Ink Characterization

The images printed from the examples were evaluated by measuring the optical densities in three area patches with maximum ink coverage, and averaging, using an X-Rite™ Photographic Densitometer.

Waterfastness was determined by immersing samples of printed images in distilled water for 1 hour and then allowed to dry for at least 12 hours. The optical density was measured before immersion in water and after immersion in water and drying. Waterfastness is determined as the percent of retained optical density after immersion in water and drying. After the samples had been immersed in water for half an hour the samples were physically rubbed to ascertain if the pigmented ink image would rub off with pressure (wet adhesion). This was done on a $D_{max}$ patch (100% fill), at a mid-density point (0.50–1.0), and on narrow lines (~1/32nd of an inch). They were subjectively rated based on the following scale: excellent=no discerable difference in image density or appearance, very good=very slight density loss, good=moderate density loss, fair=image rubs of easily, and poor=image floats off surface of paper while immersed in water.

BALD Comparative Examples 1–4 and BALD Examples 1–13 are summarized in the following Table I—Blocked Aldehydes.

TABLE 1

| | | | Blocked Aldehydes | | | | |
|---|---|---|---|---|---|---|---|
| Example | Pigment | Overcoat Additive | Density Before | Density After | % Retained Density | Wet Adhesion ($D_{max}$ Patch) | Wet Adhesion ($D_{min}$ + Lines) |
| BALD Comp. 1 | cyan | None | 1.83 | 1.31 | 71 | Fair | Poor |
| BALD Comp. 2 | p.r. 122 | None | 2.05 | .07 | 3 | Poor | Poor |
| BALD Comp. 3 | p.y. 74 | None | 2.01 | 1.27 | 63 | Poor | Poor |
| BALD Comp. 4 | cyan | None | 1.88 | 1.76 | 94 | Good | Poor |
| BALD 1 | cyan | DHD | 1.79 | 1.72 | 96 | Good | Excellent |
| BALD 2 | cyan | DHD | 1.88 | 1.71 | 91 | Good | Excellent |
| BALD 3 | cyan | DHD | 1.85 | 1.65 | 89 | Good | Excellent |
| BALD 4 | p.r. 122 | DHD | 2.03 | 1.76 | 86 | Very Good | Excellent |
| BALD 5 | p.r. 122 | DHD | 2.12 | 1.81 | 85 | Very Good | Excellent |
| BALD 6 | p.r. 122 | DHD | 2.10 | 1.76 | 83 | Excellent | Excellent |
| BALD 7 | p.y. 74 | DHD | 2.02 | 1.61 | 77 | Very Good | Excellent |
| BALD 8 | cyan | SunRez 700 | 1.84 | 1.65 | 90 | Good | Excellent |
| BALD 9 | cyan | SunRez 700 | 1.79 | 1.70 | 95 | Very Good | Excellent |
| BALD 10 | p.r. 122 | SunRez 700 | 2.04 | 2.02 | 99 | Good | Excellent |
| BALD 11 | p.r. 122 | SunRez 700 | 2.00 | 1.80 | 90 | Very Good | Excellent |
| BALD 12 | cyan | Sequarez 755 | 1.85 | 1.64 | 88 | Excellent | Excellent |
| BALD 13 | p.r. 122 | Sequarez 755 | 2.20 | 1.73 | 79 | Excellent | Excellent |

BALD = Blocked Aldehydes; DHD = 2,3-dihydroxy-1,4-dioxane; p.r = pigment red; p.y. = pigment yellow; SequaRez 755 = glyoxal polyol reaction product consisting of 1 anhydroglucose unit; 2 glyoxal units (SEQUAREZ ® 755 obtained from Sequa Chemicals, Inc.); SunRez 700 = cyclic urea glyoxal condensate consisting of 1 cyclic urea unit: 1 glyoxal unit (SUNREZ ® 700 obtained from Sequa Chemicals, Inc.)

The results indicate that significant enhancement of the waterfastness and wet adhesion properties of printed images, printed on gelatin, can be achieved when an overcoat solution containing blocked aldehydes such as 2,3-dihydroxy-1,4-dioxane (DHD), Sequa SUNREZ® 700, and Sequa SEQUAREZ® 755 are overcoated onto the pigmented ink image.

EXAMPLES OF OLEFINS (OLF)

Olefin (OLF) Comparative Example 1

This Example was carried out as described for the Blocked Aldehyde (BALD) Comparative Example 1.

Olefin (OLF) Comparative Example 2

An ink was prepared in a similar manner as described in OLF Comparative Example 1 except, the cyan pigment was replaced with 1.45 g of a quinacridone magenta pigment (pigment red 122) from Sun Chemical Co. The ink was printed as in OLF Comparative Example 1 and poor waterfastness and wet adhesion were observed.

Olefin (OLF) Comparative Example 3

An ink was prepared in the same manner as that described in OLF Example 1, except 1.12 g of cyan pigment was mixed with 8.00 g of diethylene glycol and 13.89 g of 1.8 wt % solution of BVSM was added to the mixture to obtain a final BVSM concentration of 0.50 wt % of hardener in the ink. This was printed onto coatings of paper stock which had previously been corona discharge treated (CDT) and which had been coated with an imaging layer consisting of about 800 mg/ft$^2$ of gelatin. Good waterfastness and excellent wet adhesion were observed in the 100% fill areas ($D_{max}$); however at lower density patches, and with thin narrow lines (~1/32$^{nd}$ of an inch), poor to fair wet adhesion was observed (parts of the image floated off without physically rubbing, and parts of the image required small amounts of physical force to peel off).

Olefin (OLF) Comparative Example 4

An ink was prepared in the same manner as that described in OLF Example 3, except 27.78 g of 1.8 wt % solution of BVSM was added to the mixture to obtain a final BVSM concentration of 1.00 wt % of hardener in the ink. This was printed onto coatings of paper stock which had previously been corona discharge treated (CDT) and which had been coated with an imaging layer consisting of about 800 mg/ft$^2$ of gelatin. Very good waterfastness and wet adhesion were observed in the 100% fill areas ($D_{max}$); however at lower density patches, and with thin narrow lines (~1/32$^{nd}$ of an inch), poor to fair wet adhesion was observed.

Olefin (OLF) Comparative Example 5

An ink was prepared in the same manner as that described in OLF Example 3, except 12.50 g of 2.0 wt % solution of BVSME was added to the mixture to obtain a final BVSME concentration of 0.50 wt % of hardener in the ink. This was printed onto coatings of paper stock which had previously been corona discharge treated (CDT) and which had been coated with an imaging layer consisting of about 800 mg/ft$^2$ of gelatin. Excellent waterfastness and good wet adhesion were observed in the 100% fill areas ($D_{max}$); and at lower density patches, and with thin narrow lines (~1/32$^{nd}$ of an inch), poor to fair wet adhesion was observed.

Olefin (OLF) Comparative Example 6

An ink was prepared in the same manner as that described in OLF Example 3, except 25.0 g of 2.0 wt % solution of BVSME was added to the ink to obtain a final BVSME concentration of 1.0 wt % of hardener in the ink. This was printed onto coatings of paper stock which had previously been corona discharge treated (CDT) and which had been coated with an imaging layer consisting of about 800 mg/ft$^2$ of gelatin. Very good waterfastness and good wet adhesion were observed in the 100% fill areas ($D_{max}$); and at lower density patches, and with thin narrow lines (~1/32$^{nd}$ of an inch), poor to fair wet adhesion was observed.

Olefin (OLF) Example 1

An ink was prepared in the same manner as that described in OLF Comparative Example 1. This ink was printed on resin coated paper stock which had been previously treated with a corona discharge treatment (CDT) and coated with an imaging layer consisting of about 800 mg/ft$^2$ of gelatin.

A solution consisting of 8.0 g of diethylene glycol, 5.00 g of a 10.0% solution of Air Products Surfynol® 465, and 12.50 g of 2.0 wt % solution of BVSME was added to the mixture to obtain a final hardener concentration of 0.50 wt % of hardener in the solution, and additional deionized water for a total of 50.0 g was prepared. The overcoat solution was introduced into an empty Hewlett-Packard 51626A print cartridge. This solution was overcoated at 100% coverage on the above pigmented ink image. Good waterfastness and wet adhesion were observed in the 100% fill areas ($D_{max}$). Excellent waterfastness and wet adhesion properties were also observed at lower density patches, and with thin narrow lines (~1/32$^{nd}$ of an inch).

Olefin (OLF) Example 2

An ink was prepared and printed as in OLF Example 1. A solution consisting of 8.0 g of diethylene glycol, 5.00 g of a 10.0% solution of Air Products Surfynol® 465, and 25.00 g of 2.0 wt % solution of BVSME was added to the mixture to obtain a final hardener concentration of 1.00 wt % of hardener in the solution, and additional deionized water for a total of 50.0 g was prepared. This solution was overcoated on the above pigmented ink image. Very good waterfastness and wet adhesion were observed in the 100% fill areas ($D_{max}$). Excellent waterfastness and wet adhesion properties were also observed at lower density patches, and with thin narrow lines (~1/32$^{nd}$ of an inch).

Olefin (OLF) Example 3

An ink was prepared in the same manner as that described in OLF Comparative Example 2. This ink was printed on resin coated paper stock which had been previously treated with a corona discharge treatment (CDT) and coated with an imaging layer consisting of about 800 mg/f$^2$ of gelatin.

A solution consisting of 8.0 g of diethylene glycol, 5.00 g of a 10.0% solution of Air Products Surfynol® 465, and 12.50 g of 2.0 wt % solution of BVSME was added to the mixture to obtain a final hardener concentration of 0.50 wt % of hardener in the solution, and additional deionized water for a total of 50.0 g was prepared. This solution was overcoated on the above pigmented ink image. Excellent waterfastness and good wet adhesion were observed in the 100% fill areas ($D_{max}$). Excellent waterfastness and wet adhesion properties were also observed at lower density patches, and with thin narrow lines (~1/32$^{nd}$ of an inch).

Olefin (OLF) Example 4

An ink was prepared and printed as in OLF Example 3. A solution consisting of 8.0 g of diethylene glycol, 5.00 g of a 10.0% solution of Air Products Surfynol® 465, and 25.00 g of 2.0 wt % solution of BVSME was added to the mixture to obtain a final hardener concentration of 1.00 wt % of hardener in the solution, and additional deionized water for a total of 50.0 g was prepared. This solution was overcoated on the above pigmented ink image. Excellent waterfastness and wet adhesion were observed in the 100% fill areas ($D_{max}$). Excellent waterfastness and wet adhesion properties were also observed at lower density patches, and with thin narrow lines (~1/32$^{nd}$ of an inch).

Olefin (OLF) Example 5

An ink was prepared in the same manner as that described in OLF Comparative Example 1. This ink was printed on resin coated paper stock which had been previously treated with a corona discharge treatment (CDT) and coated with an imaging layer consisting of about 800 mg/ft$^2$ of gelatin.

A solution consisting of 8.0 g of diethylene glycol, 5.00 g of a 10.0% solution of Air Products Surfynol® 465, and 13.89 g of 1.80 wt % solution of BVSM was added to the mixture to obtain a final hardener concentration of 0.50 wt % of hardener in the solution, and additional deionized water for a total of 50.0 g was prepared. This solution was overcoated on the above pigmented ink image. Very good waterfastness and good wet adhesion were observed in the 100% fill areas ($D_{max}$). Excellent waterfastness and wet adhesion properties were also observed at lower density patches, and with thin narrow lines (~1/32$^{nd}$ of an inch).

Olefin (OLF) Example 6

An ink was prepared and printed as in OLF Example 1. A solution consisting of 8.0 g of diethylene glycol, 5.00 g of a 10.0% solution of Air Products Surfynol® 465, and 27.78 g of 1.80 wt % solution of BVSM was added to the mixture to obtain a final hardener concentration of 1.00 wt % of hardener in the solution, and additional deionized water for a total of 50.0 g was prepared. This solution was overcoated on the above pigmented ink image. Excellent waterfastness and very good wet adhesion were observed in the 100% fill areas ($D_{max}$). Excellent waterfastness and wet adhesion properties were also observed at lower density patches, and with thin narrow lines (~1/32$^{nd}$ of an inch).

Olefin (OLF) Example 7

An ink was prepared in the same manner as that described in OLF Comparative Example 2. This ink was printed on resin coated paper stock which had been previously treated with a corona discharge treatment (CDT) and coated with an imaging layer consisting of about 800 mg/ft$^2$ of gelatin.

A solution consisting of 8.0 g of diethylene glycol, 5.00 g of a 10.0% solution of Air Products Surfynol® 465, and 13.89 g of 1.80 wt % solution of BVSM was added to the mixture to obtain a final hardener concentration of 0.50 wt % of hardener in the solution, and additional deionized water for a total of 50.0 g was prepared. This solution was overcoated on the above pigmented ink image. Very good waterfastness and wet adhesion were observed in the 100% fill areas ($D_{max}$). Excellent waterfastness and wet adhesion properties were also observed at lower density patches, and with thin narrow lines (~1/32$^{nd}$ of an inch).

Olefin (OLF) Example 8

An ink was prepared and printed as in OLF Example 3. A solution consisting of 8.0 g of diethylene glycol, 5.00 g of a 10.0% solution of Air Products Surfynol® 465, and 27.78 g of 1.80 wt % solution of BVSM was added to the mixture to obtain a finalhardener concentration of 1.00 wt % of hardener in the solution, and additional deionized water for a total of 50.0 g was prepared. This solution was overcoated on the above pigmented ink image. Excellent waterfastness and wet adhesion were observed in the 100% fill areas ($D_{max}$). Excellent waterfastness and wet adhesion properties were also observed at lower density patches, and with thin narrow lines (~1/32$^{nd}$ of an inch).

Ink Characterization

The images printed from the examples were evaluated by measuring the optical densities in three area patches with maximum ink coverage, and averaging, using an X-Rite™ Photographic Densitometer.

Waterfastness was determined as described above for the aldehyde Examples.

OLF Comparative Examples 1–6 and OLF Examples 1–8 are summarized in the following Table 2.

TABLE 2

Olefin Examples

| Example | Pigment | Overcoat Additive | Density Before | Density After | % Retained Density | Wet Adhesion (Dmax Patch) | Wet Adhesion (Dmin + Lines) |
|---|---|---|---|---|---|---|---|
| OLF Comp. 1 | cyan | None | 1.84 | .62 | 34 | Poor | Poor |
| OLF Comp. 2 | p.r. 122 | None | 2.14 | 1.52 | 71 | Fair | Poor |
| OLF Comp. 3 | cyan | None | 1.85 | 1.56 | 85 | Excellent | Poor–Fair |
| OLF Comp. 4 | cyan | None | 1.63 | 1.51 | 92 | Excellent | Poor–Fair |
| OLF Comp. 5 | cyan | None | 1.76 | 1.77 | 100 | Good | Poor–Fair |
| OLF Comp. 6 | cyan | None | 1.84 | 1.65 | 90 | Good | Poor–Fair |
| OLF 1 | cyan | BVSME | 1.80 | 1.55 | 86 | Good | Excellent |
| OLF 2 | cyan | BVSME | 1.82 | 1.62 | 89 | Very Good | Excellent |
| OLF 3 | p.r. 122 | BVSME | 2.09 | 2.01 | 96 | Good | Excellent |
| OLF 4 | p.r. 122 | BVSME | 2.01 | 1.96 | 97 | Excellent | Excellent |
| OLF 5 | cyan | BVSM | 1.79 | 1.67 | 93 | Good | Excellent |
| OLF 6 | cyan | BVSM | 1.83 | 1.78 | 97 | Very Good | Excellent |
| OLF 7 | p.r. 122 | BVSM | 1.98 | 1.75 | 88 | Very Good | Excellent |
| OLF 8 | p.r. 122 | BVSM | 1.95 | 2.00 | 102 | Excellent | Excellent |

OLF = Olefin; p.r. = pigment red; BVSM = bis-(vinylsulfonyl)-methane; BVSME = bis-(vinylsulfonylmethyl) ether The results indicate that significant enhancement of the waterfastness and wet adhesion properties of printed images, printed on gelatin, can be achieved when an overcoat solution containing containing active olefins such as bis-(vinylsufonylmethyl) ether, bis-(vinylsulfonyl)-methane and the like are overcoated onto the pigmented ink image.

Aldehyde (ALD) Comparative Example 1

This Example was carried out as described for the Blocked Aldehyde (BALD) Comparative Example 1.

The resin coated paper stock had been previously treated with a corona discharge treatment (CDT) and coated with an imaging layer consisting of about 800 mg/ft$^2$ of gelatin. Poor waterfastness and wet adhesion was observed.

Adehyde (ALD) Comparative Example 2

An ink was prepared in a similar manner as described in ALD Comparative Example 1 except, the cyan pigment was replaced with 1.45 g of a quinacridone magenta pigment (pigment red 122) from Sun Chemical Co. The ink was printed as in Comparative Example 1 and poor waterfastness and wet adhesion were observed in the $D_{max}$ and $D_{min}$ areas.

Aldehyde (ALD) Comparative Example 3

An ink was prepared in the same manner as that described in ALD Comparative Example 1 except, an aliquot of the above cyan dispersion to yield 1.12 g pigment was mixed with 8.0 g of diethylene glycol, and 1.35 g of 37 wt % solution of formaldehyde obtained from Aldrich Chemicals was added to the mixture to obtain a final hardener concentration of 1.00 wt % of hardener in the ink, and additional deionized water for a total of 50.0 g.

This ink was printed on resin coated paper stock which had been previously treated with a corona discharge treatment (CDT) and coated with an imaging layer consisting of about 800 mg/ft$^2$ of gelatin. Very good waterfastness was observed in the 100% fill areas ($D_{max}$), while the wet adhesion in the $D_{max}$ patch was fair to good. At lower density patches (0.50) and thin narrow lines (~1/32$^{nd}$ of an inch), the pigmented ink image exhibited poor waterfastness and wet adhesion properties.

Aldehyde (ALD) Example 1

An ink was prepared in the same manner as that described in ALD Comparative Example 1. This ink was printed on resin coated paper stock which had been previously treated with a corona discharge treatment (CDT) and coated with an imaging layer consisting of about 800 mg/ft$^2$ of gelatin.

A solution consisting of 8.0 g of diethylene glycol, 5.00 g of a 10.0% solution of Air Products Surfynol® 465, and 0.68 g of 37 wt % solution of formaldehyde obtained from Aldrich Chemicals was added to the mixture to obtain a final hardener concentration of 0.50 wt % of hardener in the solution, and additional deionized water for a total of 50.0 g was prepared. The overcoat solution was introduced into an empty Hewlett-Packard 51626A print cartridge. This solution was overcoated at 100% coverage on the above pigmented ink image. Excellent waterfastness and very good wet adhesion were observed in the 100% fill areas ($D_{max}$). Excellent waterfastness and wet adhesion properties were also observed at lower density patches, and with thin narrow lines (~1/32$^{nd}$ of an inch).

Aldehyde (ALD) Example 2

An ink was prepared in the same manner as that described in ALD Comparative Example 1. This ink was printed on resin coated paper stock which had been previously treated with a corona discharge treatment (CDT) and coated with an imaging layer consisting of about 800 mg/ft$^2$ of gelatin.

A solution consisting of 8.0 g of diethylene glycol, 5.00 g of a 10.0% solution of Air Products Surfynol® 465, and 2.03 g of 37 wt % solution of formaldehyde obtained from Aldrich Chemicals was added to the mixture to obtain a final hardener concentration of 1.50 wt % of hardener in the solution, and additional deionized water for a total of 50.0 g was prepared. This solution was overcoated on the above pigmented ink image. Excellent waterfastness and wet adhesion were observed in the 100% fill areas ($D_{max}$). Excellent waterfastness and wet adhesion properties were also observed at lower density patches, and with thin narrow lines (~1/32$^{nd}$ of an inch).

Aldehyde (ALD) Example 3

An ink was prepared in the same manner as that described in ALD Comparative Example 2. This ink was printed on resin coated paper stock which had been previously treated with a corona discharge treatment (CDT) and coated with an imaging layer consisting of about 800 mg/ft$^2$ of gelatin.

A solution consisting of 8.0 g of diethylene glycol, 5.00 g of a 10.0% solution of Air Products Surfynol® 465, and 0.68 g of 37 wt % solution of formaldehyde obtained from Aldrich Chemicals was added to the mixture to obtain a final hardener concentration of 0.50 wt % of hardener in the solution, and additional deionized water for a total of 50.0 g was prepared. This solution was overcoated on the above pigmented ink image. Excellent waterfastness and wet adhesion were observed in the 100% fill areas ($D_{max}$). Excellent waterfastness and wet adhesion properties were also observed at lower density patches, and with thin narrow lines (~1/32$^{nd}$ of an inch).

Aldehyde (ALD) Example 4

An ink was prepared in the same manner as that described in ALD Comparative Example 2. This ink was printed on resin coated paper stock which had been previously treated with a corona discharge treatment (CDT) and coated with an imaging layer consisting of about 800 mg/ft$^2$ of gelatin.

A solution consisting of 8.0 g of diethylene glycol, 5.00 g of a 10.0% solution of Air Products Surfynol® 465, and 2.03 g of 37 wt % solution of formaldehyde obtained from Aldrich Chemicals was added to the mixture to obtain a final hardener concentration of 1.50 wt % of hardener in the solution, and additional deionized water for a total of 50.0 g was prepared. This solution was overcoated on the above pigmented ink image. Excellent waterfastness and wet adhesion were observed in the 100% fill areas ($D_{max}$). Excellent waterfastness and wet adhesion properties were also observed at lower density patches, and with thin narrow lines (~1/32$^{nd}$ of an inch).

Aldehyde (ALD) Example 5

An ink was prepared in the same manner as that described in ALD Comparative Example 1. This ink was printed on resin coated paper stock which had been previously treated with a corona discharge treatment (CDT) and coated with an imaging layer consisting of about 800 mg/ft$^2$ of gelatin.

A solution consisting of 8.0 g of diethylene glycol, 5.00 g of a 10.0% solution of Air Products Surfynol® 465, and 1.25 g of 40 wt % solution of glyoxal obtained from Aldrich Chemicals was added to the mixture to obtain a final hardener concentration of 1.0 wt % of hardener in the solution, and additional deionized water for a total of 50.0 g was prepared. This solution was overcoated on the above pigmented ink image. Good waterfastness and very good wet adhesion were observed in the 100% fill areas ($D_{max}$). Excellent waterfastness and wet adhesion properties were also observed at lower density patches, and with thin narrow lines (~1/32$^{nd}$ of an inch).

Aldehyde (ALD) Example 6

An ink was prepared in the same manner as that described in ALD Comparative Example 2. This ink was printed on resin coated paper stock which had been previously treated with a corona discharge treatment (CDT) and coated with an imaging layer consisting of about 800 mg/ft$^2$ of gelatin A solution consisting of 8.0 g of diethylene glycol, 5.00 g of a 10.0% solution of Air Products Surfynol® 465, and 1.25 g of 40 wt % solution of glyoxal obtained from Aldrich Chemicals was added to the mixture to obtain a final hardener concentration of 1.0 wt % of hardener in the solution, and additional deionized water for a total of 50.0 g was prepared. This solution was overcoated on the above pigmented ink image. Excellent waterfastness and very good wet adhesion were observed in the 100% fill areas ($D_{max}$). Excellent waterfastness and wet adhesion properties were also observed at lower density patches, and with thin narrow lines (~1/32$^{nd}$ of an inch).

Ink Characterization

The images printed from the examples were evaluated by measuring the optical densities in three area patches with maximum ink coverage, and averaging, using an X-Rite™ Photographic Densitometer.

Waterfastness was determined by the method described above for Blocked Aldehydes.

ALD Comparative Examples 1–3 and ALD Examples 1–6 are summarized in the following Table 3.

TABLE 3

| Aldehyde Examples | | | | | | | |
|---|---|---|---|---|---|---|---|
| Example | Pigment | Overcoat Additive | Density Before | Density After | % Retained Density | Wet Adhesion ($D_{max}$ Patch) | Wet Adhesion ($D_{min}$ + Lines) |
| ALD Comp. 1 | cyan | None | 1.84 | .62 | 34 | Poor | Poor |
| ALD Comp. 2 | p.r. 122 | None | 2.14 | 1.52 | 71 | Fair | Poor |
| ALD Comp. 3 | cyan | None | 1.68 | 1.49 | 89 | Fair–Good | Poor |
| ALD 1 | cyan | FA | 1.78 | 1.62 | 91 | Very Good | Excellent |
| ALD 2 | cyan | FA | 1.79 | 1.71 | 96 | Excellent | Excellent |
| ALD 3 | p.r. 122 | FA | 2.03 | 1.73 | 85 | Excellent | Excellent |
| ALD 4 | p.r. 122 | FA | 2.10 | 1.92 | 91 | Excellent | Excellent |
| ALD 5 | cyan | glyoxal | 1.89 | 1.56 | 82 | Good | Excellent |
| ALD 6 | p.r. 122 | glyoxal | 2.03 | 2.06 | 101 | Very Good | Excellent |

ALD = Aldehydes; p.r. = pigment red; FA = formaldehyde

The results indicate that significant enhancement of the waterfastness and wet adhesion properties of printed images, printed on gelatin, can be achieved when an overcoat solution containing aldehydes such as formaldehyde and glyoxal are overcoated onto the pigmented ink image.

Inorganic (IO) Comparative Example 1

This Example was prepared as described above for BALD Comparative Example 1, for Blocked Aldehydes.

The resin coated paper stock had been previously treated with a corona discharge treatment (CDT) and coated with an imaging layer consisting of about 800 mg/ft$^2$ of gelatin. Poor waterfastness and wet adhesion were observed in the Dmax areas. In the low density patches (0.50), and with narrow lines (~1/32$^{nd}$ of an inch) the pigmented ink image floated to the surface immediately when immersed in distilled water.

Inorganic (IO) Comparative Example 2

An ink was prepared in a similar manner as described in IO Comparative Example 1 except, the cyan pigment was replaced with 1.45 g of a quinacridone magenta pigment (pigment red 122) from Sun Chemical Co. The ink was printed as in Comparative Example 1 and poor waterfastness and wet adhesion were observed.

Inorganic (IO) Comparative Example 3

An ink was prepared in a similar manner as described in IO Comparative Example 1 except, the cyan pigment was replaced with 1.25 g of a Hansa Brilliant Yellow (pigment yellow 74) from Hoechst Chemical Co. The ink was printed as in Comparative Example 1 and poor waterfastness and wet adhesion were observed.

Inorganic (IO) Example 1

An ink was prepared in the same manner as that described in IO Comparative Example 1. This ink was printed on resin coated paper stock which had been previously treated with a corona discharge treatment (CDT) and coated with an imaging layer consisting of about 800 mg/ft$^2$ of gelatin.

A solution consisting of 8.0 g of diethylene glycol 5.00 g of a 10.0% solution of Air Products Surfynol® 465, and 0.50 g of 25 wt % solution of aluminum sulfate ($Al_2(SO_4)_3$ $18H_2O$) obtained from Acros Organics was added to the mixture to obtain a final hardener concentration of 0.25 wt % of hardener in the solution, and additional deionized water for a total of 50.0 g was prepared. The overcoat solution was introduced into an empty Hewlett-Packard 51626A print cartridge. This solution was overcoated at 100% coverage on the above pigmented ink image. Excellent waterfastness and good wet adhesion were observed in the 100% fill areas ($D_{max}$). Very good waterfastness and wet adhesion properties were observed at lower density patches, and with thin narrow lines (~1/32$^{nd}$ of an inch).

Inorganic (IO) Example 2

An ink was prepared in the same manner as that described in IO Comparative Example 2. This ink was printed on resin coated paper stock which had been previously treated with a corona discharge treatment (CDT) and coated with an imaging layer consisting of about 800 mg/ft$^2$ of gelatin.

A solution consisting of 8.0 g of diethylene glycol, 5.00 g of a 10.0% solution of Air Products Surfynol® 465, and 0.50 g of 25 wt % solution of aluminum sulfate ($Al_2(SO_4)_3$ $18H_2O$) obtained from Acros Organics was added to the mixture to obtain a final hardener concentration of 0.25. wt % of hardener in the solution, and additional deionized water for a total of 50.0 g was prepared. This solution was overcoated on the above pigmented ink image. Good waterfastness and wet adhesion were observed in the 100% fill areas ($D_{max}$). Excellent waterfastness and wet adhesion properties were observed at lower density patches, and with thin narrow lines (~1/32$^{nd}$ of an inch).

Inorganic (IO) Example 3

An ink was prepared in the same manner as that described in IO Comparative Example 3. This ink was printed on resin coated paper stock which had been previously treated with a corona discharge treatment (CDT) and coated with an imaging layer consisting of about 800 mg/ft$^2$ of gelatin.

A solution consisting of 8.0 g of diethylene glycol, 5.00 g of a 10.0% solution of Air Products Surfynol® 465, and 0.50 g of 25 wt % solution of aluminum sulfate ($Al_2(SO_4)_3$ $18H_2O$) obtained from Acros Organics was added to the mixture to obtain a final hardener concentration of 0.25 wt % of hardener in the solution, and additional deionized water for a total of 50.0 g was prepared. This solution was overcoated on the above pigmented ink image. Excellent waterfastness and very good wet adhesion were observed in the 100% fill areas ($D_{max}$). Excellent waterfastness and wet adhesion properties were observed at lower density patches, and with thin narrow lines (~1/32$^{nd}$ of an inch).

Inorganic (IO) Example 4

An ink was prepared in the same manner as that described in IO Comparative Example 1. This ink was printed on resin coated paper stock which had been previously treated with a corona discharge treatment (CDT) and coated with an imaging layer consisting of about 800 mg/ft$^2$ of gelatin.

A solution consisting of 8.0 g of diethylene glycol, 5.00 g of a 10.0% solution of Air Products Surfynol® 465, and 1.0 g of 25 wt % solution of aluminum sulfate ($Al_2(SO4)_3$ $18H_2O$) obtained from Acros Organics was added to the mixture to obtain a final hardener concentration of 0.50 wt % of hardener in the solution, and additional deionized water for a total of 50.0 g was prepared. This solution was overcoated on the above pigmented ink image. Excellent waterfastness and very good wet adhesion were observed in the 100% fill areas ($D_{max}$). Excellent waterfastness and wet adhesion properties were observed at lower density patches, and with thin narrow lines (~1/32$^{nd}$ of an inch).

Inorganic (IO) Example 5

An ink was prepared in the same manner as that described in IO Comparative Example 2. This ink was printed on resin coated paper stock which had been previously treated with a corona discharge treatment (CDT) and coated with an imaging layer consisting of about 800 mg/ft$^2$ of gelatin.

A solution consisting of 8.0 g of diethylene glycol, 5.00 g of a 10.0% solution of Air Products Surfynol® 465, and 1.0 g of 25 wt % solution of aluminum sulfate ($A_2(SO_4)_3$ $18H_2O$) obtained from Acros Organics was added to the mixture to obtain a final hardener concentration of 0.50 wt % of hardener in the solution, and additional deionized water for a total of 50.0 g was prepared. This solution was overcoated on the above pigmented ink image. Good waterfastness and wet adhesion were observed in the 100% fill areas ($D_{max}$). Excellent waterfastness and wet adhesion properties were observed at lower density patches, and with thin narrow lines (~1/32$^{nd}$ of an inch).

Inorganic (IO) Example 6

An ink was prepared in the same manner as that described in 10 Comparative Example 3. This ink was printed on resin coated paper stock which had been previously treated with a corona discharge treatment (CDT) and coated with an imaging layer consisting of about 800 mg/ft$^2$ of gelatin.

A solution consisting of 8.0 g of diethylene glycol, 5.00 g of a 10.0% solution of Air Products Surfynol® 465, and 1.0 g of 25 wt % solution of aluminum sulfate ($Al_2(SO_4)_3$ $18H_2O$) obtained from Acros Organics was added to the mixture to obtain a final hardener concentration of 0.50 wt % of hardener in the solution, and additional deionized water for a total of 50.0 g was prepared. This solution was overcoated on the above pigmented ink image. Excellent waterfastness and very good wet adhesion were observed in the 100% fill areas ($D_{max}$). Excellent waterfastness and wet adhesion properties were observed at lower density patches, and with thin narrow lines (~1/32$^{nd}$ of an inch).

Inorganic (IO) Example 7

An ink was prepared in the same manner as that described in IO Comparative Example 1. This ink was printed on resin coated paper stock which had been previously treated with a corona discharge treatment (CDT) and coated with an imaging layer consisting of about 800 mg/ft$^2$ of gelatin.

A solution consisting of 8.0 g of diethylene glycol, 5.00 g of a 10.0% solution of Air Products Surfynol® 465, and 2.0 g of 25 wt % solution of aluminum sulfate ($Al_2(SO_4)_3$ $18H_2O$) obtained from Acros Organics was added to the mixture to obtain a final hardener concentration of 1.0 wt % of hardener in the solution, and additional deionized water for a total of 50.0 g was prepared. This solution was overcoated on the above pigmented ink image. Excellent waterfastness and very good wet adhesion were observed in the 100% fill areas ($D_{max}$). Excellent waterfastness and wet adhesion properties were observed at lower density patches, and with thin narrow lines (~1/32$^{nd}$ of an inch).

Inorganic (IO) Example 8

An ink was prepared in the same manner as that described in IO Comparative Example 2. This ink was printed on resin coated paper stock which had been previously treated with a corona discharge treatment (CDT) and coated with an imaging layer consisting of about 800 mg/ft$^2$ of gelatin.

A solution consisting of 8.0 g of diethylene glycol, 5.00 g of a 10.0% solution of Air Products Surfynol® 465, and 2.0 g of 25 wt % solution of aluminum sulfate ($Al_2(SO_4)_3$ $18H_2O$) obtained from Acros Organics was added to the mixture to obtain a final hardener concentration of 1.0 wt % of hardener in the solution, and additional deionized water for a total of 50.0 g was prepared. This solution was overcoated on the above pigmented ink image. Excellent waterfastness and wet adhesion wereobserved in the 100% fill areas ($D_{max}$). Excellent waterfastness and wet adhesion properties were also observed at lower density patches, and with thin narrow lines (~1/32$^{nd}$ of an inch).

Inorganic (IO) Example 9

An ink was prepared in the same manner as that described in IO Comparative Example 1. This ink was printed on resin coated paper stock which had been previously treated with a corona discharge treatment (CDT) and coated with an imaging layer consisting of about 800 mg/ft$^2$ of gelatin.

A solution consisting of 8.0 g of diethylene glycol, 5.00 g of a 10.0% solution of Air Products Surfynol® 465, and 8.62 g of a 5.8 wt % solution of $TiO_2$ (Sequalink® TXL obtained from Sequa Chemicals Inc.) was added to the mixture to obtain a final hardener concentration of 1.0 wt % of hardener in the solution, and additional deionized water for a total of 50.0 g was prepared. This solution was overcoated on the above pigmented ink image. Very good waterfastness and wet adhesion were observed in the 100% fill areas ($D_{max}$). Very good waterfastness and wet adhesion properties were also observed at lower density patches, and with thin narrow lines (~1/32$^{nd}$ of an inch).

Inorganic (IO) Example 10

An ink was prepared in the same manner as that described in IO Comparative Example 2. This ink was printed on resin coated paper stock which had been previously treated with a corona discharge treatment (CDT) and coated with an imaging layer consisting of about 800 mg/ft$^2$ of gelatin.

A solution consisting of 8.0 g of diethylene glycol, 5.00 g of a 10.0% solution of Air Products Surfynol® 465, and 8.62 g of a 5.8 wt % solution of $TiO_2$ (Sequalink® TXL obtained from Sequa Chemicals Inc.) was added to the mixture to obtain a final hardener concentration of 1.0 wt % of hardener in the solution, and additional deionized water for a total of 50.0 g was prepared This solution was overcoated on the above pigmented ink image. Good waterfastness and very good wet adhesion were observed in the 100% fill areas ($D_{max}$). Excellent waterfastness and wet adhesion were observed at lower density patches, and with thin narrow lines (~1/32$^{nd}$ of an inch).

Inorganic (IO) Example 11

An ink was prepared in the same manner as that described in 10 Comparative Example 3. This ink was printed on resin coated paper stock which had been previously treated with a corona discharge treatment (CDT) and coated with an imaging layer consisting of about 800 mg/ft$^2$ of gelatin.

A solution consisting of 8.0 g of diethylene glycol, 5.00 g of a 10.0% solution of Air Products Surfynol® 465, and 8.62 g of a 5.8 wt % solution of $TiO_2$ (Sequalink® TXL obtained from Sequa Chemicals Inc.) was added to the mixture to obtain a final hardener concentration of 1.0 wt % of hardener in the solution, and additional deionized water for a total of 50.0 g was prepared This solution was overcoated on the above pigmented ink image. Good waterfastness and very good wet adhesion were observed in the 100% fill areas ($D_{max}$). Excellent waterfastness and wet adhesion were observed at lower density patches, and with thin narrow lines (~1/32$^{nd}$ of an inch).

Inorganic (IO) Example 12

An ink was prepared in the same manner as that described in IO Comparative Example 1. This ink was printed on resin coated paper stock which had been previously treated with a corona discharge treatment (CDT) and coated with an imaging layer consisting of about 800 mg/ft$^2$ of gelatin.

A solution consisting of 8.0 g of diethylene glycol, 5.00 g of a 10.0% solution of Air Products Surfynol® 465, and 7.14 g of a 7.0 wt % solution of $ZrO_2$ (Sequarez® 82 obtained from Sequa Chemicals Inc.) was added to the mixture to obtain a final hardener concentration of 1.0 wt % of hardener in the solution, and additional deionized water for a total of 50.0 g was prepared This solution was overcoated on the above pigmented ink image. Very good waterfastness and excellent wet adhesion were observed in the 100% fill areas ($D_{max}$). Excellent waterfastness and wet adhesion were also observed at lower density patches, and with thin narrow lines (~1/32$^{nd}$ of an inch).

Inorganic (IO) Example 13

An ink was prepared in the same manner as that described in IO Comparative Example 2. This ink was printed on resin coated paper stock which had been previously treated with a corona discharge treatment (CDT) and coated with an imaging layer consisting of about 800 mg/ft$^2$ of gelatin.

A solution consisting of 8.0 g of diethylene glycol, 5.00 g of a 10.0% solution of Air Products Surfynol® 465, and 7.14 g of a 7.0 wt % solution of $ZrO_2$ (Sequarez® 82 obtained from Sequa Chemicals Inc.) was added to the mixture to obtain a final hardener concentration of 1.0 wt % of hardener in the solution, and additional deionized water for a total of 50.0 g was prepared. This solution was overcoated on the above pigmented ink image. Excellent waterfastness and very good wet adhesion were observed in the 100% fill areas ($D_{max}$). Excellent waterfastness and wet adhesion were observed at lower density patches, and with thin narrow lines (~1/32$^{nd}$ of an inch).

Inorganic (IO) Example 14

An ink was prepared in the same manner as that described in IO Comparative Example 3. This ink was printed on resin coated paper stock which had been previously treated with a corona discharge treatment (CDT) and coated with an imaging layer consisting of about 800 mg/ft$^2$ of gelatin.

A solution consisting of 8.0 g of diethylene glycol, 5.00 g of a 10.0% solution of Air Products Surfynol® 465, and 7.14 g of a 7.0 wt % solution of $ZrO_2$ (Sequarez® 82 obtained from Sequa Chemicals Inc.) was added to the mixture to obtain a final hardener concentration of 1.0 wt % of hardener in the solution, and additional deionized water for a total of 50.0 g was prepared. This solution was overcoated on the above pigmented ink image. Excellent waterfastness and very good wet adhesion were observed in the 100% fill areas ($D_{max}$). Excellent waterfastness and wet adhesion were observed at lower density patches, and with thin narrow lines (~1/32$^{nd}$ of an inch).

Inorganic (IO) Example 15

An ink was prepared in the same manner as that described in IO Comparative Example 1. This ink was printed on resin coated paper stock which had been previously treated with a corona discharge treatment (CDT) and coated with an imaging layer consisting of about 800 mg/ft$^2$ of gelatin.

A solution consisting of 8.0 g of diethylene glycol, 5.00 g of a 10.0% solution of Air Products Surfynol® 465, and 2.50 g of a 20 wt % solution of ammonium zirconium carbonate (BaCote™ 20 obtained from Magnesium Elektron, Inc.) was added to the mixture to obtain a final hardener concentration of 1.0 wt % of hardener in the solution, and additional deionized water for a total of 50.0 g was prepared. This solution was overcoated on the above pigmented ink image. Very good waterfastness and good wet adhesion were observed in the 100% fill areas ($D_{max}$). Excellent waterfastness and wet adhesion were also observed at lower density patches, and with thin narrow lines (~1/32$^{nd}$ of an inch).

Inorganic (IO) Example 16

An ink was prepared in the same manner as that described in IO Comparative Example 2. This ink was printed on resin coated paper stock which had been previously treated with a corona discharge treatment (CDT) and coated with an imaging layer consisting of about 800 mg/ft$^2$ of gelatin.

A solution consisting of 8.0 g of diethylene glycol, 5.00 g of a 10.0% solution of Air Products Surfynol® 465, and 2.50 g of a 20 wt % solution of ammonium zirconium carbonate (BaCote™ 20 obtained from Magnesium Elektron, Inc.) was added to the mixture to obtain a final hardener concentration of 1.0 wt % of hardener in the solution, and additional deionized water for a total of 50.0 g was prepared. This solution was overcoated on the above pigmented ink image. Excellent waterfastness and fair to good wet adhesion were observed in the 100% fill areas ($D_{max}$). Excellent waterfastness and wet adhesion were observed at lower density patches, and with thin narrow lines (~1/32$^{nd}$ of an inch).

Inorganic (IO) Example 17

An ink was prepared in the same manner as that described in IO Comparative Example 3. This ink was printed on resin coated paper stock which had been previously treated with a corona discharge treatment (CDT) and coated with an imaging layer consisting of about 800 mg/ft$^2$ of gelatin.

A solution consisting of 8.0 g of diethylene glycol, 5.00 g of a 10.0% solution of Air Products Surfynol® 465, and 2.50 g of a 20 wt % solution of ammonium zirconium carbonate (BaCote® 20 obtained from Magnesium Elektron, Inc) was added to the mixture to obtain a final hardener concentration of 1.0 wt % of hardener in the solution, and additional deionized water for a total of 50.0 g was prepared. This solution was overcoated on the above pigmented ink image. Very good waterfastness and wet adhesion were observed in the 100% fill areas ($D_{max}$). Excellent waterfastness and wet adhesion were observed at lower density patches, and with thin narrow lines (~1/32$^{nd}$ of an inch).

Ink Characterization

The images printed from the examples were evaluated by measuring the optical densities in three area patches with maximum ink coverage, and averaging, using an X-Rite™ Photographic Densitometer.

Waterfastness was determined by the method already above described for Blocked Aldehydes.

IO Comparative Examples 1–3 and IO Examples 1–17 are summarized in the following Table 4.

TABLE 4

| | | Inorganic Compounds | | | | | |
|---|---|---|---|---|---|---|---|
| Example | Pigment | Overcoat Additive | Density Before | Density After | % Retained Density | Wet Adhesion ($D_{max}$ Patch) | Wet Adhesion ($D_{min}$ + Lines) |
| IO Comp. 1 | cyan | None | 1.83 | 1.31 | 71 | Fair | Poor |
| IO Comp. 2 | p.r. 122 | None | 2.05 | .07 | 3 | Poor | Poor |
| IO Comp. 3 | p.y. 74 | None | 2.01 | 1.27 | 63 | Poor | Poor |
| IO 1 | cyan | $Al_2(SO_4)_3$ | 1.86 | 1.74 | 93 | Good | Very Good |
| IO 2 | p.r. 122 | $Al_2(SO_4)_3$ | 2.11 | 1.54 | 71 | Good | Excellent |
| IO 3 | p.y. 74 | $Al_2(SO_4)_3$ | 1.94 | 1.92 | 99 | Very Good | Excellent |
| IO 4 | cyan | $Al_2(SO_4)_3$ | 1.83 | 1.72 | 94 | Very Good | Excellent |
| IO 5 | p.r. 122 | $Al_2(SO_4)_3$ | 2.14 | 1.97 | 92 | Fair–Good | Excellent |
| IO 6 | p.y. 74 | $Al_2(SO_4)_3$ | 1.94 | 2.02 | 104 | Very Good | Excellent |
| IO 7 | cyan | $Al_2(SO_4)_3$ | 1.85 | 1.88 | 102 | Very Good | Excellent |
| IO 8 | p.r. 122 | $Al_2(SO_4)_3$ | 1.93 | 2.00 | 103 | Excellent | Excellent |
| IO 9 | cyan | Sequalink TXL | 1.85 | 1.71 | 92 | Very Good | Very Good |
| IO 10 | p.r. 122 | Sequalink TXL | 2.11 | 1.56 | 74 | Very Good | Excellent |

TABLE 4-continued

| Inorganic Compounds | | | | | | | |
|---|---|---|---|---|---|---|---|
| Example | Pigment | Overcoat Additive | Density Before | Density After | % Retained Density | Wet Adhesion ($D_{max}$ Patch) | Wet Adhesion ($D_{min}$ + Lines) |
| IO 11 | p.y. 74 | Sequalink TXL | 1.92 | 1.54 | 80 | Very Good | Excellent |
| IO 12 | cyan | Sequarez 82 | 1.85 | 1.63 | 88 | Excellent | Excellent |
| IO 13 | p.r. 122 | Sequarez 82 | 2.05 | 1.96 | 95 | Very Good | Excellent |
| IO 14 | p.y. 74 | Sequarez 82 | 1.94 | 1.85 | 95 | Very Good | Excellent |
| IO 15 | cyan | BaCote 20 | 1.85 | 1.72 | 93 | Good | Excellent |
| IO 16 | p.r. 122 | BaCote 20 | 2.02 | 1.94 | 96 | Fair–Good | Excellent |
| IO 17 | p.y. 74 | BaCote 20 | 1.77 | 1.62 | 92 | Very Good | Excellent |

IO = Inorganic Compound; p.y. = pigment yellow; p.r. = pigment red; $Al_2(SO_4)_3$ = aluminum sulfate ($Al_2(SO_4)_3 18H_2O$); Sequalink TXL = $TiO_2$ salt (Sequalink ® TXL obtained from Sequa Chemicals Inc.); Sequarez 82 = $ZrO_2$ salt (Sequarez ® 82 obtained from Sequa Chemicals Inc.); BaCote 20 = ammonium zirconium carbonate (BaCote ™ 20 obtained from Magnesium Elektron, Inc.)

The results indicate that significant enhancement of the waterfastness and wet adhesion properties of printed images, printed on gelatin, can be achieved when an overcoat solution containing an inorganic hardener such as aluminum sulfate, ammonium zirconium carbonate, and salts of zirconium dioxide, and titanium dioxide are overcoated onto the pigmented ink image.

Inorganic and Organic (IO) Comparative Example 1

This example is similar to BALD Comparative Example 1, above for Blocked Aldehydes.

The resin coated paper stock had been previously treated with a corona discharge treatment (CDT) and coated with an imaging layer consisting of about 800 mg/ft$^2$ of gelatin. Poor waterfastness and wet adhesion were observed in the $D_{max}$ areas. In the low density patches (0.50), and with narrow lines (~1/32$^{nd}$ of an inch) the pigmented ink image floated to the surface immediately when immersed in distilled water.

Inorganic and Organic (IO) Comparative Example 2

An ink was prepared in a similar manner as described in IO/O Comparative Example 1 except, the cyan pigment was replaced with 1.45 g of a quinacridone magenta pigment (pigment red 122) from Sun Chemical Co, 6.0 g of diethylene glycol was added to the ink, and additional deionized water for a total of 50 grams. The ink was printed as in Comparative Example 1 and poor waterfastness and wet adhesion were observed.

Inorganic and Organic (IO) Comparative Example 3

An ink was prepared and printed in the same manner as that described in Example 2.

An overcoat solution was prepared consisting of 8.0 g of diethylene glycol, 5.00 g of a 10.0% solution of Air Products Surfynol® 465, 1.25 g of 10 wt % solution of 2,3-dihydroxy-1,4-dioxane (DHD) obtained from Aldrich Chemicals to obtain a final hardener concentration of 0.25 wt % of hardener in the solution, and additional deionized water for a total of 50.0 g. The overcoat solution was introduced into an empty Hewlett-Packard 51626A print cartridge. This solution was overcoated at 100% coverage on the above pigmented ink image. Good waterfastness properties were observed in the 100% fill areas (77% density retention). Poor wet adhesion properties were observed in the 100% fill areas ($D_{max}$)(28% retention), and very poor coalescence were observed in the non $D_{max}$ areas.

Inorganic and Organic (IO/O) Comparative Example 4

An ink was prepared and printed in the same manner as that described in IO/O Comparative Example 2.

An overcoat solution was prepared consisting of 8.0 g of diethylene glycol, 5.00 g of a 10.0% solution of Air Products Surfynol® 465, 2.50 g of 10 wt % solution of 2,3-dihydroxy-1,4-dioxane (DHD) obtained from Aldrich Chemicals to obtain a final hardener concentration of 0.50 wt % of hardener in the solution, and additional deionized water for a total of 50.0 g. This solution was overcoated on the above pigmented ink image. Very good waterfastness properties were observed in the 100% fill areas (87% density retention). Poor wet adhesion properties were observed in the 100% fill areas ($D_{max}$)(41% retention), and very poor coalescence was observed in the non $D_{max}$ areas.

Inorganic and Organic (IO) Comparative Example 5

An ink was prepared and printed in the same manner as that described in IO/O Comparative Example 2.

An overcoat solution was prepared consisting of 8.0 g of diethylene glycol, 5.00 g of a 10.0% solution of Air Products Surfynol® 465, 5.00 g of 10 wt % solution of 2,3-dihydroxy-1,4-dioxane (DHD) obtained from Aldrich Chemicals to obtain a final hardener concentration of 1.00 wt % of hardener in the solution, and additional deionized water for a total of 50.0 g. This solution was overcoated on the above pigmented ink image. Very good waterfastness properties were observed in the 100% fill areas (90% density retention). Poor wet adhesion properties were observed in the 100% fill areas ($D_{max}$)(52% retention), and very poor coalescence was observed in the non $D_{max}$ areas.

Inorganic and Organic (IO) Comparative Example 6

An ink was prepared and printed in the same manner as that described in IO/O Comparative Example 2.

An overcoat solution was prepared consisting of 8.0 g of diethylene glycol, 5.00 g of a 10.0% solution of Air Products Surfynol® 465, 10.00 g of 10 wt % solution of 2,3-dihydroxy-1,4-dioxane (DHD) obtained from Aldrich Chemicals to obtain a final hardener concentration of 2.00 wt % of hardener in the solution, and additional deionized water for a total of 50.0 g. This solution was overcoated on the above pigmented ink image. Very good waterfastness properties was observed in the 100% fill areas (87% density retention). Good wet adhesion properties were observed in the 100% fill areas ($D_{max}$)(61% retention), and very poor coalescence was observed in the non $D_{max}$ areas.

Inorganic and Organic (IO) Comparative Example 7

An ink was prepared and printed in the same manner as that described in IO/O Comparative Example 2.

A solution was prepared consisting of 8.0 g of diethylene glycol, 5.00 g of a 10.0% solution of Air Products Surfynol® 465, 0.625 g of 20 wt % solution of chromium(III) potassium sulfate dodecahydrate ($CrK(SO_4)_2 12H_2O$) obtained from Aldrich Chemicals to obtain a final hardener concentration of 0.25 wt % of hardener in the solution, and additional deionized water for a total of 50.0 g. This solution was overcoated on the above pigmented ink image.

Excellent waterfastness properties was measured in the 100% fill areas (100% density retention). Poor wet adhesion properties were observed in the 100% fill areas ($D_{max}$)(42% retention), and excellent coalescence was observed throughout the image.

Inorganic and Organic (IO) Comparative Example 8

An ink was prepared and printed in the same manner as that described in IO/O Comparative Example 2.

A solution was prepared consisting of 8.0 g of diethylene glycol, 5.00 g of a 10.0% solution of Air Products Surfynol® 465, 1.25 g of 20 wt % solution of chromium(III) potassium sulfate dodecahydrate ($CrK(SO_4)_2 12H_2O$) obtained from Aldrich Chemicals to obtain a final hardener concentration of 0.50 wt % of hardener in the solution, and additional deionized water for a total of 50.0 g. This solution was overcoated on the above pigmented ink image.

Very good waterfastness properties were measured in the 100% fill areas (89% density retention). Poor wet adhesion properties were observed in the 100% fill areas ($D_{max}$)(51% retention), and excellent coalescence was observed throughout the image.

Inorganic and Organic (IO) Comparative Example 9

An ink was prepared and printed in the same manner as that described in IO/O Comparative Example 2.

A solution was prepared consisting of 8.0 g of diethylene glycol, 5.00 g of a 10.0% solution of Air Products Surfynol® 465, 2.50 g of 20 wt % solution of chromium(III) potassium sulfate dodecahydrate ($CrK(SO_4)_2 12H_2O$) obtained from Aldrich Chemicals to obtain a final hardener concentration of 1.0 wt % of hardener in the solution, and additional deionized water for a total of 50.0 g. This solution was overcoated on the above pigmented ink image.

Excellent waterfastness properties were measured in the 100% fill areas (95% density retention). Poor wet adhesion properties were observed in the 100% fill areas ($D_{max}$)(55% retention), and excellent coalescence was observed throughout the image.

Inorganic and Organic (IO) Comparative Example 10

An ink was prepared and printed in the same manner as that described in IO/O Comparative Example 2.

A solution was prepared consisting of 8.0 g of diethylene glycol, 5.00 g of a 10.0% solution of Air Products Surfynol® 465, 0.50 g of 25 wt % solution of aluminum sulfate ($Al_2(SO_4)_3 18H_2O$) obtained from Acros Organics to obtain a final hardener concentration of 0.25 wt % of hardener in the solution, and additional deionized water for a total of 50.0 g. This solution was overcoated on the above pigmented ink image.

Fair to good waterfastness properties were measured in the 100% fill areas (73% density retention). Very poor wet adhesion properties were observed in the 100% fill areas ($D_{max}$)(25% retention), and excellent coalescence was observed throughout the image.

Inorganic and Organic (IO) Comparative Example 11

An ink was prepared and printed in the same manner as that described in IO/O Comparative Example 2.

A solution was prepared consisting of 8.0 g of diethylene glycol, 5.00 g of a 10.0% solution of Air Products Surfynol® 465, 1.0 g of 25 wt % solution of aluminum sulfate ($Al_2(SO_4)_3 18H_2O$) obtained from Acros Organics to obtain a final hardener concentration of 0.50 wt % of hardener in the solution, and additional deionized water for a total of 50.0 g. This solution was overcoated on the above pigmented ink image.

Excellent waterfastness properties were measured in the 100% fill areas (92% density retention). Very poor wet adhesion properties were observed in the 100% fill areas ($D_{max}$)(27% retention), and excellent coalescence was observed throughout the image.

Inorganic and Organic (IO) Comparative Example 12

An ink was prepared and printed in the same manner as that described in IO/O Comparative Example 2.

A solution was prepared consisting of 8.0 g of diethylene glycol, 5.00 g of a 10.0% solution of Air Products Surfynol® 465, 2.0 g of 25 wt % solution of aluminum sulfate ($Al_2(SO_4)_3 18H_2O$) obtained from Acros Organics to obtain a final hardener concentration of 1.0 wt % of hardener in the solution, and additional deionized water for a total of 50.0 g. This solution was overcoated on the above pigmented ink image.

Excellent waterfastness properties were measured in the 100% fill areas (96% density retention). Very poor wet adhesion properties were observed in the 100% fill areas ($D_{max}$)(32% retention), and excellent coalescence was observed throughout the image.

Inorganic and Organic (IO) Comparative Example 13

An ink was prepared and printed in the same manner as that described in IO/O Comparative Example 2.

A solution was prepared consisting of 8.0 g of diethylene glycol, 5.00 g of a 10.0% solution of Air Products Surfynol® 465, 4.0 g of 25 wt % solution of aluminum sulfate ($Al_2(SO_4)_3 18H_2O$) obtained from Acros Organics to obtain a final hardener concentration of 2.0 wt % of hardener in the solution, and additional deionized water for a total of 50.0 g. This solution was overcoated on the above pigmented ink image.

Excellent waterfastness properties were measured in the 100% fill areas (95% density retention). Very poor wet adhesion properties were observed in the 100% fill areas ($D_{max}$)(38% retention), and excellent coalescence was observed throughout the image.

Inorganic and Organic (IO) Comparative Example 14

An ink was prepared and printed in the same manner as that described in IO/O Comparative Example 1.

An overcoat solution was prepared consisting of 8.0 g of diethylene glycol, 5.00 g of a 10.0% solution of Air Products Surfynol® 465, 5.00 g of 10 wt % solution of 2,3-dihydroxy-1,4-dioxane (DHD) obtained from Aldrich Chemicals to obtain a final hardener concentration of 1.00 wt % of hardener in the solution, and additional deionized water for a total of 50.0 g. This solution was overcoated on the above pigmented ink image. Very good waterfastness properties were observed in the 100% fill areas (91% density retention). Good adhesion properties were observed in the 100% fill areas ($D_{max}$)(77% retention), and very poor coalescence was observed in the non $D_{max}$ areas.

Inorganic and Organic (IO) Comparative Example 15

An ink was prepared and printed in the same manner as that described in IO/O Comparative Example 1.

An overcoat solution was prepared consisting of 8.0 g of diethylene glycol, 5.00 g of a 10.0% solution of Air Products Surfynol® 465, 10.00 g of 10 wt % solution of 2,3-dihydroxy-1,4-dioxane 1 (DHD) obtained from Aldrich Chemicals to obtain a final hardener concentration of 2.00 wt % of hardener in the solution, and additional deionized water for a total of 50.0 g. This solution was overcoated on the above pigmented ink image. Very good waterfastness properties were observed in the 100% fill areas (92% density retention). Good wet adhesion properties were observed in the 100% fill areas ($D_{max}$)(64% retention), and very poor coalescence was observed in the non $D_{max}$ areas.

Inorganic and Organic (IO) Comparative Example 16

An ink was prepared and printed in the same manner as that described in IO/O Comparative Example 1.

A solution was prepared consisting of 8.0 g of diethylene glycol, 5.00 g of a 10.0% solution of Air Products Surfynol® 465, 2.0 g of 25 wt % solution of aluminum sulfate ($Al_2(SO_4)_3$ $18H_2O$) obtained from Acros Organics to obtain a final hardener concentration of 1.0 wt % of hardener in the solution, and additional deionized water for a total of 50.0 g. This solution was overcoated on the above pigmented ink image.

Excellent waterfastness properties were measured in the 100% fill areas (98% density retention). Very poor wet adhesion properties were observed in the 100% fill areas ($D_{max}$)(40% retention), and excellent coalescence was observed throughout the image.

Inorganic and Organic (IO) Comparative Example 17

An ink was prepared and printed in the same manner as that described in IO/O Comparative Example 1.

A solution was prepared consisting of 8.0 g of diethylene glycol 5.00 g of a 10.0% solution of Air Products Surfynol® 465, 4.0 g of 25 wt % solution of aluminum sulfate ($Al_2(SO_4)_3$ $18H_2O$) obtained from Acros Organics to obtain a final hardener concentration of 2.0 wt % of hardener in the solution, and additional deionized water for a total of 50.0 g. This solution was overcoated on the above pigmented ink image.

Excellent waterfastness properties were measured in the 100% fill areas (92% density retention). Poor wet adhesion properties were observed in the 100% fill areas ($D_{max}$)(55% retention), and excellent coalescence was observed throughout the image.

Inorganic and Organic (IO) Comparative Example 18

An ink was prepared and printed in the same manner as that described in IO/O Comparative Example 2.

A solution was prepared consisting of 8.0 g of diethylene glycol, 5.00 g of a 10.0% solution of Air Products Surfynol® 465, 1.25 g of 20 wt % solution of chromium(III) potassium sulfate dodecahydrate ($CrK(SO_4)_2 12H_2O$) obtained from Aldrich Chemicals to obtain a final hardener concentration of 0.50 wt % of hardener in the solution, and additional deionized water for a total of 50.0 g. This solution was overcoated on the above pigmented ink image.

Very good waterfastness properties were measured in the 100% fill areas (87% density retention). Poor wet adhesion properties were observed in the 100% fill areas ($D_{max}$)(56% retention), and excellent coalescence was observed throughout the image.

Inorganic and Organic (IO/O) Comparative Example 19

An ink was prepared and printed in the same manner as that described in IO/O Comparative Example 1.

A solution was prepared consisting of 8.0 g of diethylene glycol, 5.00 g of a 10.0% solution of Air Products Surfynol® 465, 2.50 g of 20 wt % solution of chromium(III) potassium sulfate dodecahydrate ($CrK(SO_4)_2 12H_2O$) obtained from Aldrich Chemicals to obtain a final hardener concentration of 1.0 wt % of hardener in the solution, and additional deionized water for a total of 50.0 g. This solution was overcoated on the above pigmented ink image.

Very good waterfastness properties were measured in the 100% fill areas (90% density retention). Good wet adhesion properties were observed in the 100% fill areas ($D_{max}$)(62% retention), and excellent coalescence was observed throughout the image.

Inorganic and Organic (IO) Example 1

An ink was prepared and printed in the same manner as that described in IO/O Comparative Example 2.

An overcoat solution was prepared consisting of 8.0 g of diethylene glycol, 5.00 g of a 10.0% solution of Air Products Surfynol® 465, 1.25 g of 10 wt % solution of 2,3-dihydroxy-1,4-dioxane (DHD) obtained from Aldrich Chemicals to obtain a DHD concentration of 0.25 wt % of DHD in the solution, 0.50 g of 25 wt % solution of aluminum sulfate ($Al_2(SO_4)_3$ $18H_2O$) obtained from Acros Organics to obtain an aluminum sulfate concentration of 0.25 wt % of aluminum sulfate in the solution, and additional deionized water for a total of 50.0 g. This solution was overcoated on the above pigmented ink image.

Excellent waterfastness properties were observed in the 100% fill areas (91% density retention). Good wet adhesion properties were observed in the 100% fill areas ($D_{max}$)(61% retention), and excellent coalescence was observed throughout the image.

Inorganic and Organic (IO/O) Example 2

An ink was prepared and printed in the same manner as that described in IO/O Comparative Example 2.

An overcoat solution was prepared consisting of 8.0 g of diethylene glycol, 5.00 g of a 10.0% solution of Air Products Surfynol® 465, 2.50 g of 10 wt % solution of 2,3-dihydroxy-1,4-dioxane (DHD) obtained from Aldrich Chemicals to obtain a DHD concentration of 0.50 wt % of active DHD in the solution, 1.0 g of 25 wt % solution of aluminum sulfate ($Al_2(SO_4)_3$ $18H_2O$) obtained from Acros Organics to obtain an aluminum sulfate concentration of 0.50 wt % of active aluminum sulfate in the solution, and additional deionized water for a total of 50.0 g. This solution was overcoated on the above pigmented ink image.

Excellent waterfastness properties were observed in the 100% fill areas (96% density retention). Good wet adhesion properties were observed in the 100% fill areas ($D_{max}$)(71% retention), and excellent coalescence were observed throughout the image.

Inorganic and Organic (IO) Example 3

An ink was prepared and printed in the same manner as that described in IO/O Comparative Example 2.

An overcoat solution was prepared consisting of 8.0 g of diethylene glycol, 5.00 g of a 10.0% solution of Air Products Surfynol® 465, 5.0 g of 10 wt % solution of 2,3-dihydroxy-1,4-dioxane (DHD) obtained from Aldrich Chemicals to obtain a DHD concentration of 1.0 wt % of active DHD in the solution, 2.0 g of 25 wt % solution of aluminum sulfate ($Al_2(SO_4)_3$ $18H_2O$) obtained from Acros Organics to obtain an aluminum sulfate concentration of 1.0 wt % of active aluminum sulfate in the solution, and additional deionized water for a total of 50.0 g. This solution was overcoated on the above pigmented ink image.

Excellent waterfastness properties were observed in the 100% fill areas (100% density retention). Excellent wet adhesion properties were observed in the 100% fill areas ($D_{max}$)(91% retention), and excellent coalescence was observed throughout the image.

Inorganic and Organic (IO) Example 4

An ink was prepared and printed in the same manner as that described in IO/O Comparative Example 2.

An overcoat solution was prepared consisting of 8.0 g of diethylene glycol, 5.00 g of a 10.0% solution of Air Products Surfynol® 465, 1.25 g of 10 wt % solution of 2,3-dihydroxy-1,4-dioxane (DHD) obtained from Aldrich Chemicals to obtain a DHD concentration of 0.25 wt % of active DHD in the solution, 0.625 g of 20 wt % solution of chromium(III) potassium sulfate dodecahydrate ($CrK(SO_4)_2 12H_2O$) obtained from Aldrich Chemicals to obtain a chrome alum concentration of 0.25 wt % of active chrome alum in the solution, and additional deionized water for a total of 50.0 g. This solution was overcoated on the above pigmented ink image.

Excellent waterfastness properties were observed in the 100% fill areas (92% density retention). Good wet adhesion properties were observed in the 100% fill areas ($D_{max}$)(78% retention), and excellent coalescence was observed throughout the image.

Inorganic and Organic (IO/O) Example 5

An ink was prepared and printed in the same manner as that described in IO/O Comparative Example 2.

An overcoat solution was prepared consisting of 8.0 g of diethylene glycol, 5.00 g of a 10.0% solution of Air Products Surfynol® 465, 2.50 g of 10 wt % solution of 2,3-dihydroxy-1,4-dioxane (DHD) obtained from Aldrich Chemicals to obtain a DHD concentration of 0.50 wt % of active DHD in the solution, 1.25 g of 20 wt % solution of chromium(III) potassium sulfate dodecahydrate ($CrK(SO_4)_2 12H_2O$) obtained from Aldrich Chemicals to obtain a chrome alum concentration of 0.50 wt % of active chrome alum in the solution, and additional deionized water for a total of 50.0 g. This solution was overcoated on the above pigmented ink image.

Excellent waterfastness properties were observed in the 100% fill areas (91% density retention). Good wet adhesion properties were observed in the 100% fill areas ($D_{max}$)(76% retention), and excellent coalescence was observed throughout the image.

Inorganic and Organic (IO/O) Example 6

An ink was prepared and printed in the same manner as that described in IO/O Comparative Example 2.

An overcoat solution was prepared consisting of 8.0 g of diethylene glycol, 5.00 g of a 10.0% solution of Air Products Surfynol® 465, 5.0 g of 10 wt % solution of 2,3-dihydroxy-1,4-dioxane (DHD) obtained from Aldrich Chemicals to obtain a DHD concentration of 1.0 wt % of DHD in the solution, 2.50 g of 20 wt % solution of chromium(III) potassium sulfate dodecahydrate ($CrK(SO_4)_2 12H_2O$) obtained from Aldrich Chemicals to obtain a chrome alum concentration of 1.0 wt % of chrome alum in the solution, and additional deionized water for a total of 50.0 g. This solution was overcoated on the above pigmented ink image.

Excellent waterfastness properties were observed in the 100% fill areas (94% density retention). Good wet adhesion properties were observed in the 100% fill areas ($D_{max}$)(94% retention), and excellent coalescence was observed throughout the image.

Inorganic and Organic (IO/O) Example 7

An ink was prepared and printed in the same manner as that described in IO/O Comparative Example 1.

An overcoat solution was prepared consisting of 8.0 g of diethylene glycol, 5.00 g of a 10.0% solution of Air Products Surfynol® 465, 2.50 g of 10 wt % solution of 2,3-dihydroxy-1,4-dioxane (DHD) obtained from Aldrich Chemicals to obtain a DHD concentration of 0.50 wt % of DHD in the solution, 1.0 g of 25 wt % solution of aluminum sulfate ($Al_2(SO_4)_3$ $18H_2O$) obtained from Acros Organics to obtain an aluminum sulfate concentration of 0.50 wt % of aluminum sulfate in the solution, and additional deionized water for a total of 50.0 g. This solution was overcoated on the above pigmented ink image.

Excellent waterfastness properties were observed in the 100% fill areas (95% density retention). Good wet adhesion properties were observed in the 100% fill areas ($D_{max}$)(81% retention), and excellent coalescence was observed throughout the image.

Inorganic and Organic (IO/O) Example 8

An ink was prepared and printed in the same manner as that described in IO/O Comparative Example 1.

An overcoat solution was prepared consisting of 8.0 g of diethylene glycol, 5.00 g of a 10.0% solution of Air Products Surfynol® 465, 5.0 g of 10 wt % solution of 2,3-dihydroxy-1,4-dioxane (DHD) obtained from Aldrich Chemicals to obtain a DHD concentration of 1.0 wt % of DHD in the solution, 2.0 g of 25 wt % solution of aluminum sulfate ($Al_2(SO_4)_3$ $18H_2O$) obtained from Acros Organics to obtain an aluminum sulfate concentration of 1.0 wt % of aluminum sulfate in the solution, and additional deionized water for a total of 50.0 g. This solution was overcoated on the above pigmented ink image.

Excellent waterfastness properties were observed in the 100% fill areas (97% density retention). Good wet adhesion properties were observed in the 100% fill areas ($D_{max}$)(83% retention), and excellent coalescence was observed throughout the image.

Inorganic and Organic (IO/O) Example 9

An ink was prepared and printed in the same manner as that described in IO/O Comparative Example 1.

An overcoat solution was prepared consisting of 8.0 g of diethylene glycol, 5.00 g of a 10.0% solution of Air Products Surfynol® 465, 2.50 g of 10 wt % solution of 2,3-dihydroxy-1,4-dioxane (DHD) obtained from Aldrich Chemicals to obtain a DHD concentration of 0.50 wt % of DHD in the solution, 1.25 g of 20 wt % solution of chromium(III) potassium sulfate dodecahydrate ($CrK(SO_4)_2 12H_2O$) obtained from Aldrich Chemicals to obtain a chrome alum concentration of 0.50 wt % of chrome alum in the solution, and additional deionized water for a total of 50.0 g. This solution was overcoated on the above pigmented ink image.

Excellent waterfastness properties were observed in the 100% fill areas (90% density retention). Good wet adhesion properties were observed in the 100% fill areas ($D_{max}$)(76% retention), and excellent coalescence was observed throughout the image.

Inorganic and Organic (IO) Example 10

An ink was prepared and printed in the same manner as that described in 10/0 Comparative Example 1.

An overcoat solution was prepared consisting of 8.0 g of diethylene glycol, 5.00 g of a 10.0% solution of Air Products Surfynol® 465, 5.0 g of 10 wt % solution of 2,3-dihydroxy-1,4-dioxane (DHD) obtained from Aldrich Chemicals to obtain a DHD concentration of 1.0 wt % of DHD in the solution, 2.50 g of 20 wt % solution of chromium(III) potassium sulfate dodecahydrate ($CrK(SO_4)_2 12H_2O$) obtained from Aldrich Chemicals to obtain a chrome alum concentration of 1.0 wt % of chrome alum in the solution, and additional deionized water for a total of 50.0 g. This solution was overcoated on the above pigmented ink image.

Excellent waterfastness properties were observed in the 100% fill areas (97% density retention). Good wet adhesion properties were observed in the 100% fill areas ($D_{max}$)(84% retention), and excellent coalescence was observed throughout the image.

Ink Characterization

The images printed from the examples were evaluated by measuring the optical densities in three area patches with maximum ink coverage, and averaging, using an X-Rite™ Photographic Densitometer.

Waterfastness was determined by the method already disclosed with respect to the Examples for Blocked Aldehydes.

IO/O Comparative Examples 1–19 and IO/O Examples 1–10, are summarized in the following Table 5.

TABLE 5

Mixtures of Inorganic and Organic Hardeners

| Example | Pigment | Overcoat Additive | Hardener Amount (wt %) | $D_{max}$ Density Before Soak | Waterfastness (% Density Retained) | Wet Adhesion (% Density Retained) | Coalescence |
|---|---|---|---|---|---|---|---|
| IO/O Comp. 1 | cyan | None | None | 1.36 | 65 | 0 | No Image |
| IO/O Comp. 2 | p.r. 122 | None | None | 1.66 | 55 | 0 | No Image |
| IO/O Comp. 3 | p.r. 122 | DHD | 0.25 | 2.11 | 77 | 28 | Poor |
| IO/O Comp. 4 | p.r. 122 | DHD | 0.50 | 1.65 | 87 | 41 | Poor |
| IO/O Comp. 5 | p.r. 122 | DHD | 1.0 | 1.56 | 90 | 52 | Poor |
| IO/O Comp. 6 | p.r. 122 | DHD | 2.0 | 1.54 | 87 | 61 | Poor |
| IO/O Comp. 7 | p.r. 122 | $CrK(SO_4)_2 12H_2O$ | 0.25 | 1.57 | 100 | 42 | Excellent |
| IO/O Comp. 8 | p.r. 122 | $CrK(SO_4)_2 12H_2O$ | 0.50 | 1.53 | 89 | 51 | Excellent |
| IO/O Comp. 9 | p.r. 122 | $CrK(SO_4)_2 12H_2O$ | 1.0 | 1.52 | 95 | 55 | Excellent |
| IO/O Comp. 10 | p.r. 122 | $Al_2(SO_4)_3$ | .25 | 2.11 | 73 | 25 | Excellent |
| IO/O Comp. 11 | p.r. 122 | $Al_2(SO_4)_3$ | .50 | 2.14 | 92 | 27 | Excellent |
| IOIO Comp. 12 | p.r. 122 | $Al_2(SO_4)_3$ | 1.0 | 1.56 | 96 | 32 | Excellent |
| IO/O Comp. 13 | p.r. 122 | $Al_2(SO_4)_3$ | 2.0 | 1.57 | 95 | 38 | Excellent |
| IO/O Comp. 14 | cyan | DHD | 1.0 | 1.33 | 91 | 77 | Poor |
| IO/O Comp. 15 | cyan | DHD | 2.0 | 1.38 | 92 | 64 | Poor |
| IO/O Comp. 16 | cyan | $Al_2(SO_4)_3$ | 1.0 | 1.33 | 98 | 40 | Excellent |
| IO/O Comp. 17 | cyan | $Al_2(SO_4)_3$ | 2.0 | 1.36 | 92 | 55 | Excellent |
| IO/O Comp. 18 | cyan | $CrK(SO_4)_2 12H_2O$ | .5 | 1.48 | 87 | 56 | Excellent |
| IO/O Comp. 19 | cyan | $CrK(SO_4)_2 12H_2O$ | 1 | 1.39 | 90 | 62 | Excellent |
| IO/O 1 | p.r. 122 | DHD + $AlSO_4$ | .25 + .25 | 1.57 | 91 | 61 | Excellent |
| IO/O 2 | p.r. 122 | DHD + $AlSO_4$ | .50 + .50 | 1.56 | 96 | 71 | Excellent |
| IO/O 3 | p.r. 122 | DHD + $AlSO_4$ | 1.0 + 1.0 | 1.56 | 100 | 91 | Excellent |
| IO/O 4 | p.r. 122 | DHD + CrK | .25 + .25 | 1.53 | 92 | 78 | Excellent |
| IO/O 5 | p.r. 122 | DHD + CrK | .50 + .50 | 1.61 | 91 | 76 | Excellent |
| IO/O 6 | p.r. 122 | DHD + CrK | 1.0 + 1.0 | 1.54 | 94 | 94 | Excellent |
| IO/O 7 | cyan | DHD + $AlSO_4$ | .50 + .50 | 1.52 | 95 | 81 | Excellent |
| IO/O 8 | cyan | DHD + $AlSO_4$ | 1.0 + 1.0 | 1.51 | 97 | 83 | Excellent |
| IO/O 9 | cyan | DHD + CrK | .50 + .50 | 1.36 | 90 | 76 | Excellent |
| IO/O 10 | cyan | DHD + CrK | 1.0 + 1.0 | 1.4 | 97 | 84 | Excellent |

IO/O = Mixtures of Inorganic and Organic Hardeners; p.r. = pigment red; DHD = 2,3-dihydroxy-1,4-dioxane; CrK = chromium(III)potassium sulfate dodecahydrate ($CrK(SO_4)_2 12H_2O$); $AlSO_4$ = aluminum sulfate ($Al_2(SO_4)_3 18H_2O$)

The results indicate that significant enhancement of wet adhesion of images printed on gelatin can be achieved when an overcoat solution containing the combination of an organic (such as 2,3-dihydroxy-1,4-dioxane) and an inorganic hardener (such as chromium(III) potassium sulfate dodecahydrate and aluminum sulfate) are overcoated onto the pigmented ink image. The invention has been described in detail with particular reference to certain preferred embodiments thereof, but it will be understood that variations and modifications can be effected within the spirit and scope of the invention.

What is claimed is:

1. A method of improving the durability of an inkjet ink image comprising the steps of:

a) providing an ink jet ink receiving layer containing gelatin;

b) depositing pigment-based inkjet ink to form an image on the gelatin-containing ink receiving layer; and c) applying to the image formed in step b) a solution comprising a hardener selected from organic compounds with aldehyde functional groups, blocked aldehyde functional groups, and active olefinic functional groups; inorganic compounds; and combinations thereof.

2. The method of claim 1 wherein the solution is applied only to areas of the receiving layer bearing the image.

3. The method of claim 1 wherein the solution is applied to imaged and non-imaged areas of the receiving layer.

4. The method of claim 1 wherein the hardener is an organic compound selected from formaldehyde and dialdehydes.

5. The method of claim 4 wherein the hardener is an organic compound selected from the homologous series of dialdehydes ranging from glyoxal to adipaldehyde, diglycolaldehyde, and aromatic dialdehydes.

6. The method of claim 4 wherein the hardener is an organic compound selected from glutaraldehyde, succinaldehyde, and glyoxal.

7. The method of claim 1 wherein the hardener is an organic compound selected from blocked dialdehydes and N-methylol compounds.

8. The method of claim 7 wherein the hardener is an organic compound selected from 2,3-dihydroxy-1,4-dioxane, tetrahydro-4-hydroxy-5-methyl-2(1H)-pyrimidinone polymers, polymers having a glyoxal polyol reaction product consisting of 1 anhydroglucose unit: 2 glyoxal units; Dimethoxy ethanal-Melamine non-formaldehyde resins; N-methylol compounds obtained from the condensation of formaldehyde with various aliphatic or cyclic amides, ureas, and nitrogen heterocycles.

9. The method of claim 7 wherein the hardener is an organic compound 2,3-dihydroxy-1,4-dioxane.

10. The method of claim 1 wherein the hardener is an organic compound selected from active olefins and blocked active olefins.

11. The method of claim 10 wherein the hardener is an organic compound selected from divinyl ketone; resorcinol bis(vinylsulfonate); 4,6-bis(vinylsulfonyl)-m-xylene; bis (vinylsulfonylalkyl) ethers and amines; 1,3,5-tris (vinylsulfonyl) hexahydro-s-triazine; diacrylamide; 1,3-bis (acryloyl)urea; N,N'-bismaleimides; bisisomaleimides; bis (2-acetoxyethyl) ketone; 1,3,5-triacryloylhexahydro-s-triazine; and blocked active olefins of bis(2-acetoxyethyl) ketone and 3,8-dioxodecane-1,10-bis(pyridinium perchlorate).

12. The method of claim 10 wherein the hardener is an organic compound bis-(vinylsulfonyl)-methane and bis (vinylsulfonylmethyl) ether.

13. The method of claim 1 wherein the hardener is an inorganic compound selected from zirconium and titanium salts; chromium salts such as chromium sulfate and chromium alum; and aluminum salts.

14. The method of claim 13 wherein the hardener is an inorganic compound selected from aluminum sulfate and chrome alum.

15. The method of claim 13 wherein the aluminum salt is sulfate, potassium and ammonium alums.

16. The method of claim 1 wherein the hardener is a combination of an organic compound selected from organic compounds with aldehyde functional groups, blocked aldehyde functional groups, and active olefinic functional groups and an inorganic compound selected from claim 13.

17. The method of claim 16 wherein the hardener is an organic compound 2,3-dihydroxy-1,4-dioxane and the inorganic compound is aluminum sulfate.

18. The method of claim 16 wherein the concentration of combined organic and inorganic compounds is between 0.10 and 5.0 weight percent of active ingredients in the solution.

19. The method of claim 16 wherein the concentration of combined organic and inorganic compounds is between 0.25 and 2.0 weight percent of active ingredients in the solution.

20. The method of claim 1 wherein the concentration of hardener in the solution is between 0.10 and 5.0 weight percent of active ingredients in the solution.

21. The method of claim 20 wherein the concentration of hardener in the solution is between 0.25 and 2.0 weight percent of active ingredients in the solution.

22. An ink jet receiving layer treated according to the method of claim 1.

23. An ink jet ink receiver comprising:

a support having thereon an ink jet ink receiving layer containing gelatin; said ink receiving layer having thereon an image formed by pigmented ink jet ink; and a solution applied to said ink receiving layer, said solution comprising a hardener selected from organic compounds with aldehyde functional groups, blocked aldehyde functional groups, and active olefinic functional groups; inorganic compounds; and combinations thereof.

24. The ink jet ink receiver of claim 23 wherein the solution is applied only to areas of the receiving layer bearing the image.

25. The ink jet ink receiver of claim 23 wherein the solution is applied to imaged and non-imaged areas of the receiving layer.

* * * * *